US010885885B1

(12) United States Patent
Twain et al.

(10) Patent No.: US 10,885,885 B1
(45) Date of Patent: Jan. 5, 2021

(54) MUSICAL INSTRUMENT COMBINING SOUND CHARACTERISTICS OF A GUITAR AND BANJO

(71) Applicant: Kenneth M. Twain, Oakland, CA (US)

(72) Inventors: Kenneth M. Twain, Oakland, CA (US); Daniel J. Twain, Washougal, WA (US)

(73) Assignee: Kenneth M. Twain, Oakland, CA (US)

( * ) Notice: Subject to any disclaimer, the term of this patent is extended or adjusted under 35 U.S.C. 154(b) by 0 days.

(21) Appl. No.: 16/752,843

(22) Filed: Jan. 27, 2020

(51) Int. Cl.

| | |
|---|---|
| ***G10D 3/00*** | (2020.01) |
| ***G10D 1/08*** | (2006.01) |
| ***G10D 3/02*** | (2006.01) |
| ***G10D 1/10*** | (2006.01) |

(52) U.S. Cl.
CPC ..... *G10D 1/08* (2013.01); *G10D 1/10* (2013.01); *G10D 3/02* (2013.01)

(58) Field of Classification Search
CPC ..... G10D 1/08; G10D 1/10; G10D 3/02
USPC ..... 84/291
See application file for complete search history.

(56) References Cited

U.S. PATENT DOCUMENTS

| | | | | |
|---|---|---|---|---|
| 3,633,452 A * | 1/1972 | Beasley | G10D 1/08 84/263 |
| 4,738,178 A * | 4/1988 | Deering | G10H 3/182 84/171 |
| 2014/0123829 A1* | 5/2014 | Woods | G10D 1/08 84/263 |

* cited by examiner

*Primary Examiner* — Jianchun Qin
(74) *Attorney, Agent, or Firm* — Budzyn IP Law, LLC

(57) ABSTRACT

The invention provides a stringed musical instrument comprising a guitar-type hollow body, a neck joined to the hollow body, and a banjo-type pot comprising a rim, a head and a tension hoop, positioned within a first interior chamber within the hollow body. The rim and head define a second interior chamber within the banjo-type pot. The banjo-type pot is affixed to a back surface of the hollow body such that the head of the banjo-type pot is proximal to a front surface of the hollow body and distal to the back surface of the hollow body. The banjo-type pot is positioned within the first interior chamber to form a path for sound waves generated by the head to travel from a second interior chamber within the banjo-type pot through the first interior chamber and out of at least one opening provided on the front surface of the hollow body.

13 Claims, 18 Drawing Sheets

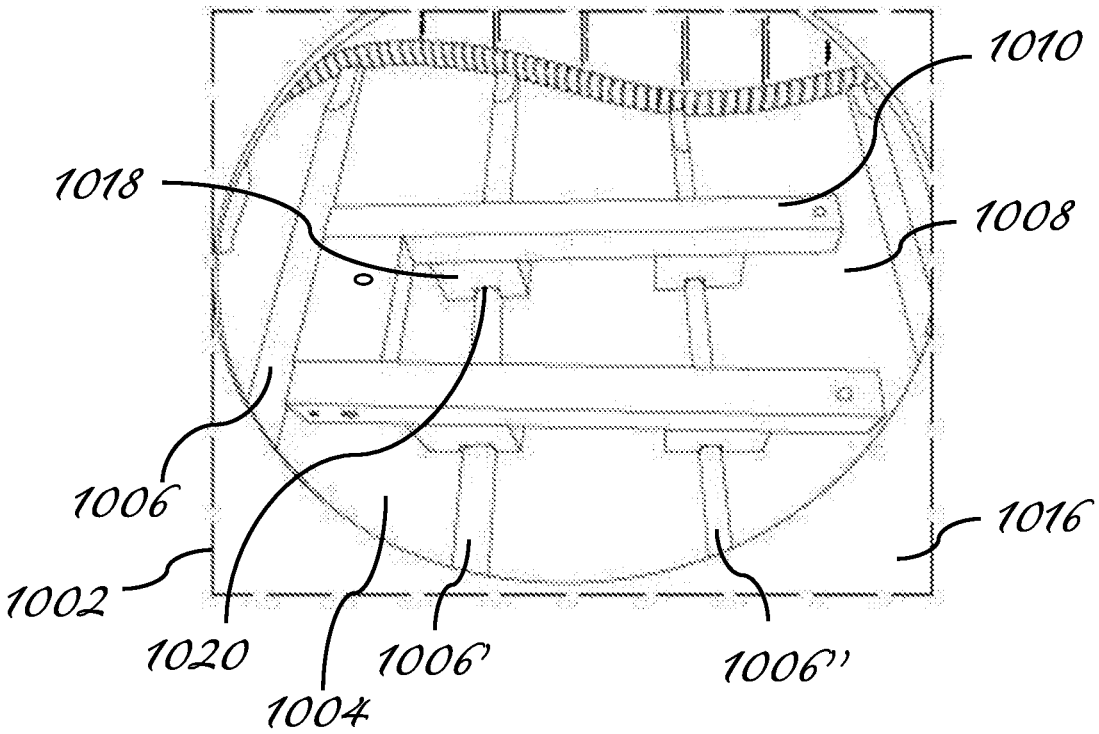
FIG. 11A
FIG. 11B
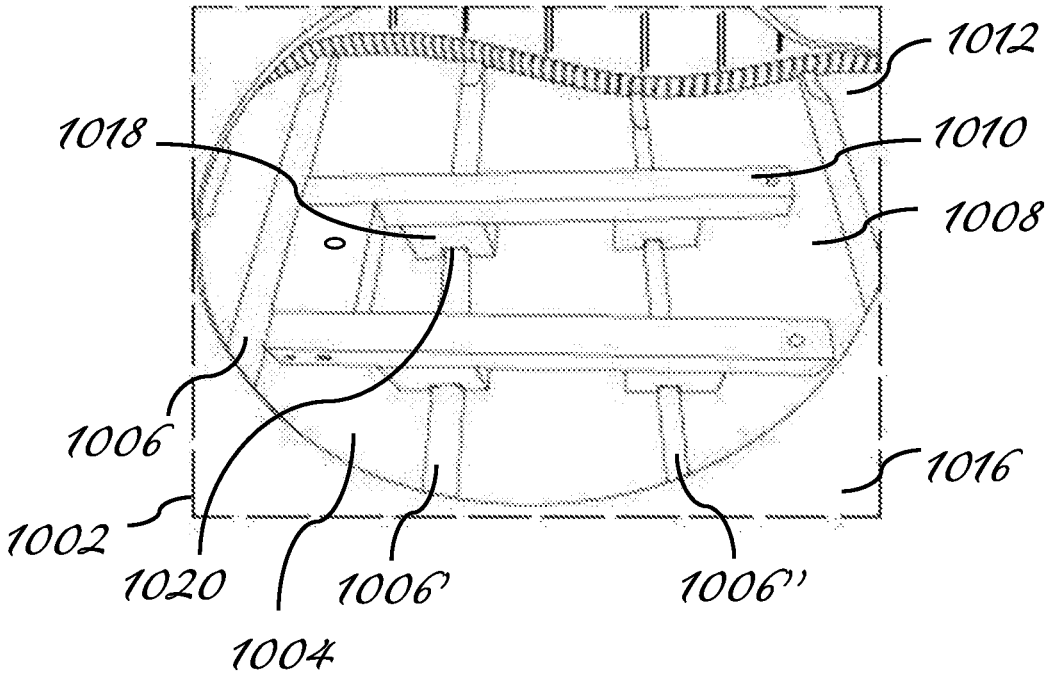

MUSICAL INSTRUMENT COMBINING SOUND CHARACTERISTICS OF A GUITAR AND BANJO

FIELD OF THE INVENTION

The present invention relates to the domain of stringed musical instruments. In particular, the invention is directed towards a musical instrument that advantageously combines sound characteristics of a guitar and a banjo into an instrument with unique, optimized tone, resonance and timbre characteristics.

BACKGROUND

There is an existing demand from musicians (particular guitar players and banjo players) for a musical instrument that combines banjo tones with the richer, resonant tones of a guitar.

Previous efforts towards combining the two instruments have included the "banjitar" which is an instrument that is physically based on a banjo configuration, with six strings tuned like a guitar. Another more recent effort is directed towards a banjo head (i.e. the resonant skin or membrane portion of the banjo) incorporated into an acoustic guitar like enclosure. The sound emanating from the prior art instrument comes from the resonance of the strings contacting the stretched skin/plastic material (the head) via a bridge that connects the string vibrations to the head. This arrangement confines the sound to mainly emanate from the banjo head, with some sound emanating from the wood used as the top of the enclosing instrument body.

It has been found that the prior art efforts provide unsatisfactory tone, resonance and timbre characteristics—particularly as the prior art instrument configurations do not consider or properly take into account the resonance causing structures of the musical instrument, and additionally interfere with sound waves as they emanate from the body of the musical instrument. It has additionally been found that existing arrangements for mounting banjo components within a guitar body invariably interfere with or dampen vibrations of the sound board of the guitar body—which results in less resonant, and more subdued instrument sound characteristics.

There is accordingly a need for a musical instrument that combines banjo tones with the richer, resonant tones of a guitar and which enables sound waves generated by the instrument's strings to emanate without significant interference and damping.

SUMMARY

The present invention is directed towards a stringed musical instrument that combines sound characteristics of a guitar and a banjo into an instrument having unique, optimized tone, resonance and timbre characteristics.

The invention provides a stringed musical instrument comprising a guitar-type hollow body, a neck, a banjo-type pot, a bridge and a set of strings.

The guitar-type hollow body comprises a front surface, a back surface and a sidewall joining the front surface and the back surface, wherein the front surface, back surface and sidewall define a first interior chamber within the hollow body, and wherein the front surface includes at least one opening provided thereon.

The neck is joined to the hollow body, wherein the neck is configured to enable strings to be strung under tension between a set of tuning pegs provided at one end of the neck and a set of one or more fasteners provided on an exterior surface of the hollow body.

The banjo-type pot comprises at least a rim, a head and a tension hoop, positioned within the first interior chamber within the hollow body, wherein the rim and head define a second interior chamber within the banjo-type pot, and wherein the banjo-type pot is affixed to the back surface of the hollow body such that the head of the banjo-type pot is positioned relatively proximal to the front surface of the hollow body and relatively distal to the back surface of the hollow body.

The bridge may be positioned on the head of the banjo type pot between the set of tuning pegs and the set of one or more fasteners provided on the exterior surface of the hollow body.

Each string within the set of strings is affixed at a first end to a tuning peg within the set of tuning pegs and at a second end to a fastener within the set of one or more fasteners provided on the exterior surface of the hollow body and strung under tension applied between the first end and the second end such that each string is passed over the bridge positioned on the head of the banjo type pot.

The banjo-type pot may be configured and positioned within the first interior chamber within the hollow body to form a path for sound waves generated by the head to travel from the second interior chamber within the banjo-type pot through the first interior chamber within the hollow body and out of the at least one opening provided on the front surface of the hollow body.

In an embodiment of the stringed musical instrument, the banjo-type pot is substantially cylindrical, and the at least one opening provided on the front surface of the hollow body may have a diameter that is greater than a diameter of the banjo-type pot at its widest point.

In a further embodiment of the stringed musical instrument, the banjo-type pot may be affixed within the first interior chamber such that an annular space is formed between a periphery of the banjo-type pot and an internal periphery of the at least one opening.

In a particular embodiment, the banjo-type pot may be affixed within the first interior chamber such that direct contact between the front surface of the hollow body and the banjo-type pot is entirely eliminated.

The stringed musical instrument may be configured such that a plane of the head of the banjo-type pot is positioned substantially level with a plane of the front surface of the hollow body.

In another embodiment, a plane of the head of the banjo-type pot is positioned within a distance of between 0 mm and 13 mm of a plane of the front surface of the hollow body. In one embodiment, the plane of the head of the banjo-type pot is positioned between 0 mm and 13 mm above the plane of the front of the guitar-type hollow body. In another embodiment, the plane of the head of the banjo-type pot is positioned between 0 mm and 13 mm below the plane of the front 504 of the guitar-type hollow body 502.

The banjo-type pot may be affixed to the back surface of the hollow body through a mount that is affixed to the back surface of the hollow body, and to which mount, one or more surfaces of the banjo-type pot is affixed.

The mount comprises at least two support members, each sized and positioned to be enable the rim of the banjo-type pot to be affixed thereto.

In an embodiment, the mount comprises a third support member interconnecting the at least two support members.

The mount may include one or more legs having one or more recesses provided thereon, wherein each recess is sized to accommodate a bracing strut located within the hollow body.

The stringed musical instrument may further comprise one or more rim fasteners, each configured to affix the rim of the banjo-type pot to the mount. The one or more of the rim fasteners may comprise height selective rim fasteners—which in an embodiment may be configured to enable the banjo-type pot to be affixed to the mount so as to ensure a pre-defined distance separating a lower surface of the rim of the banjo-type pot and an upper surface of said mount.

BRIEF DESCRIPTION OF THE ACCOMPANYING DRAWINGS

FIGS. 10A, 10B, 11A, 11B, 12A, 12B and 13 illustrate exemplary embodiments of a mount that is used for mounting a banjo-type pot within a guitar-type hollow body, affixed within the guitar-type hollow body in accordance with the teachings of the present invention.

DETAILED DESCRIPTION

The invention provides a stringed musical instrument that combines components of a guitar and a banjo into an instrument with unique, optimized tone, resonance and timbre characteristics.

Figure 1:
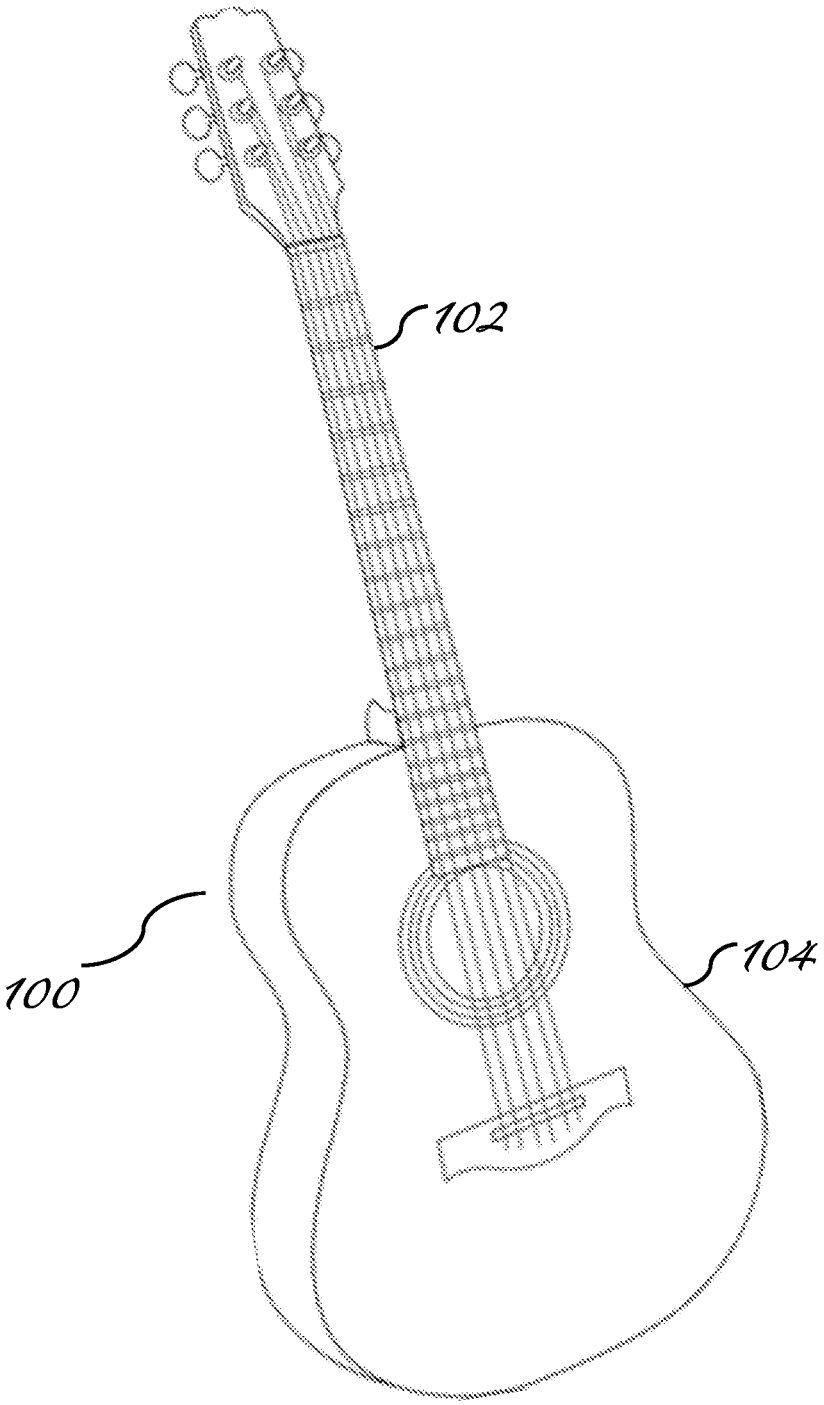
FIG. 1 illustrates an exemplary configuration for a hollow body acoustic guitar.
Figure 2:
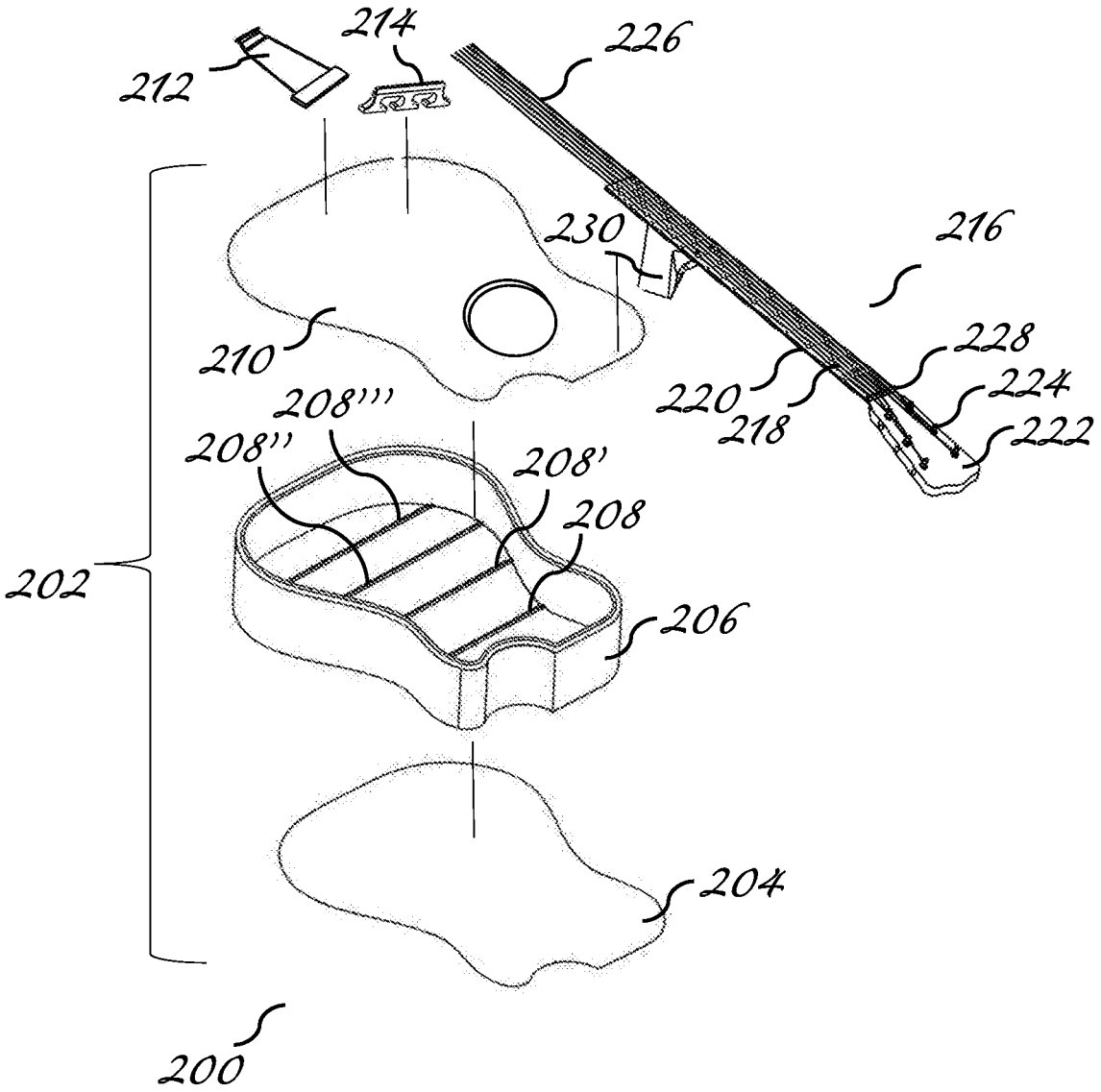
FIG. 2 is an exploded view of a hollow body acoustic guitar.

FIG. 1 illustrates an exemplary configuration for a hollow body acoustic guitar 100 comprising a guitar neck 102 and a guitar hollow body 104. The components of a typical hollow body acoustic guitar are illustrated in more detail in the exploded view of FIG. 2. As shown in FIG. 2, the hollow body 202 of acoustic guitar 200 comprises a front (sound board) 210 and a back 204 that are joined by sidewall(s) 206. The hollow body 202 may include a plurality of bracing struts 208, 208', 208", and 208'" which internally support and reinforce the sidewall(s) 206 and back 204 of the hollow body 202.

Guitar neck 216 may be joined to the hollow body 202 at heel 230—wherein neck 216 may have a fretboard 218, a plurality of frets 220, a guitar head 222, tuning pegs 224, and a nut 228 formed or disposed thereon. The hollow body 202 may additionally include a tailpiece/bridge 212 and a saddle 214 affixed on sound board 210, such that a plurality of guitar strings may be affixed at one end on tuning pegs 224 and may be run along fretboard 218 and over saddle 214 so as to be affixed at a second end to tail piece/bridge 212. By tightening the guitar strings 226 (by winding tuning pegs 224), this arrangement enables the guitar strings 226 to be strung under tension across neck 216 and sound board 210, such that vibrations of the strings 226 are transmitted to the hollow body 202 through saddle 214—which causes the hollow body to resonate and generate sound waves.

Figure 3:
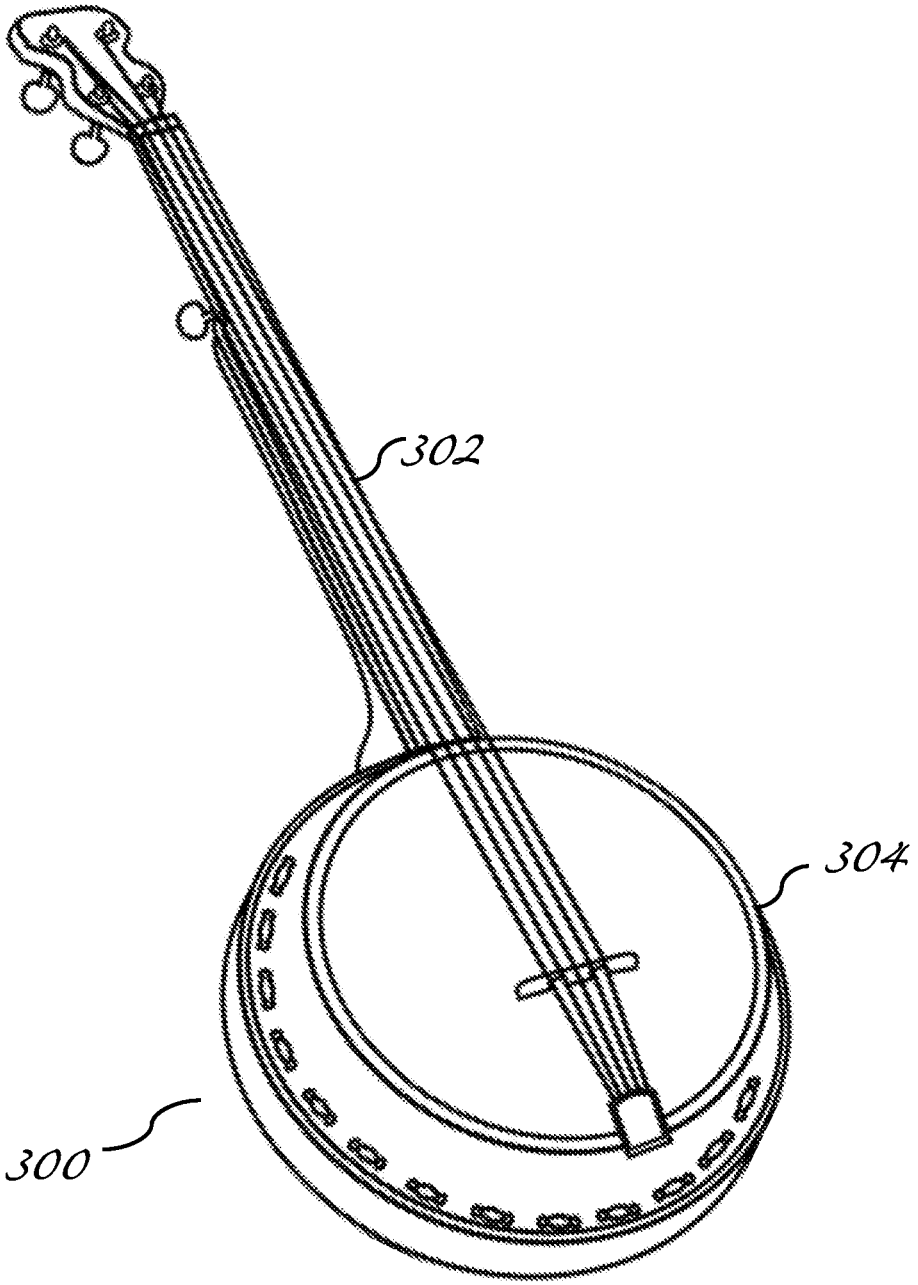
FIG. 3 illustrates an exemplary configuration for a banjo.
Figure 4:
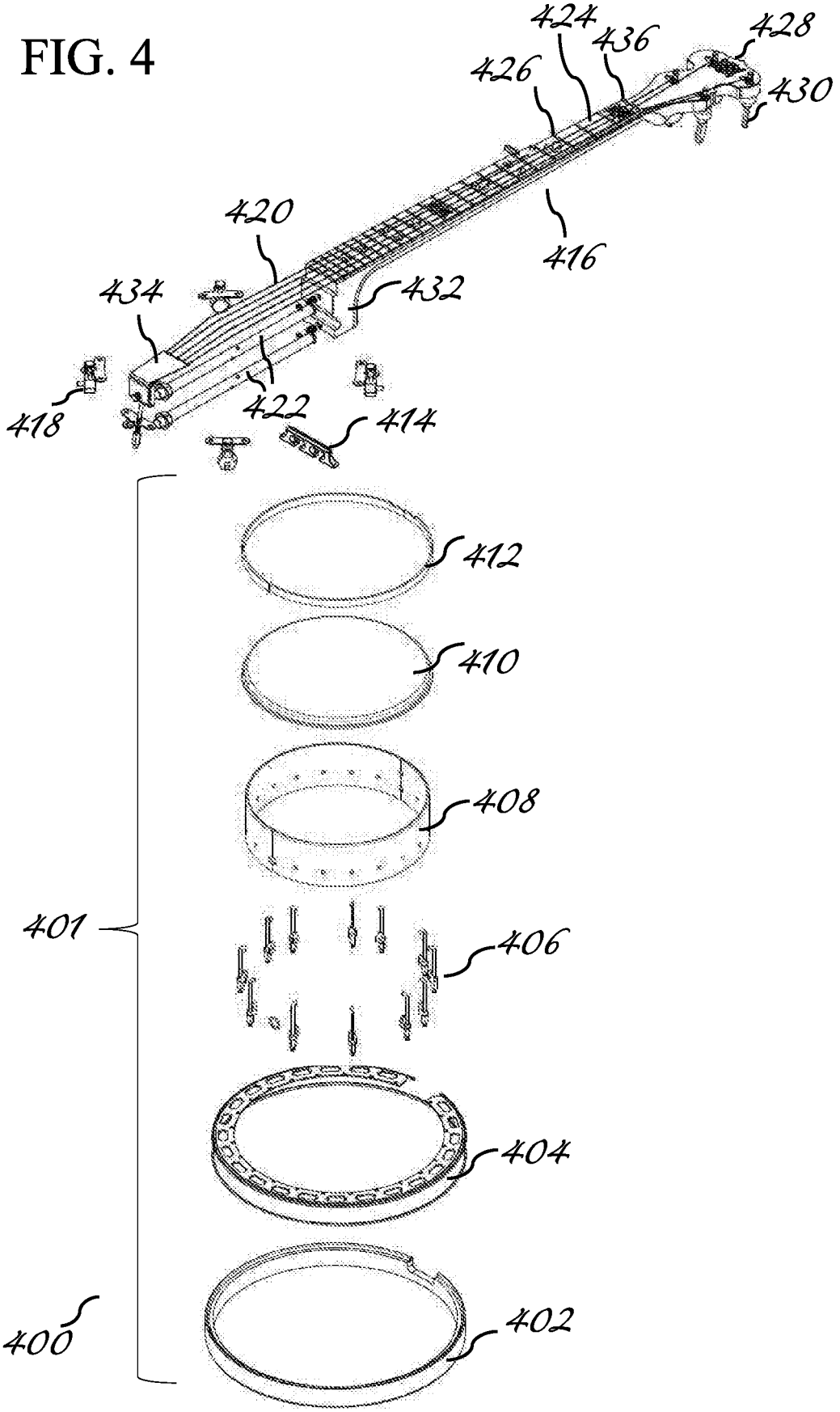
FIG. 4 is an exploded view of a banjo.

FIG. 3 illustrates an exemplary configuration for a banjo 300, comprising a banjo neck 302 and a banjo pot (or bell) 304. The components of an exemplary banjo are illustrated in more detail in the exploded view of FIG. 4. As shown in FIG. 4, the banjo 400 includes a banjo pot 401. The banjo pot 401 includes a rim 408 comprising a shell (for example, a cylindrical shell) that is open at the top and bottom ends, a head 410 comprising a membrane that forms the vibrating top of the banjo pot 401 and which is fitted over one of the two open ends of banjo pot 401, and a tension hoop 412 comprising a ring (or other periphery circumscribing structure) that fits over the head 410 and stretches head 410 tightly across rim 408. Banjo pot 401 may additionally include a plurality of brackets 406—which brackets 406 comprise fasteners that are ringed around banjo pot 401 and are configured to tighten or stretch head 410 by manipulating bracket screws that form part of said brackets 406. In an embodiment, brackets 406 may comprise a plurality of J-bolt hooks and corresponding hex nuts.

Banjo pot 401 may additionally include a resonator 402 comprising a bowl-shaped member that is affixed over the second open end of banjo pot 401, and which is configured to project or direct sound waves resonating within banjo pot 401 out and away from the pot (e.g. in a direction away from the player). Resonator 402 may be affixed to banjo pot 401 by means of a flange 404. Flange 404 comprises an annular metal plate that connects resonator 402 to banjo pot 401.

Banjo neck 416 may be joined to the banjo pot 401 at heel 432—wherein banjo neck 416 may have a fretboard 424, a plurality of frets 426, a banjo head 428, tuning pegs 430, and a nut 436 formed or disposed thereon. Banjo neck 416 may additionally include a plurality of coordinating rods 422 (comprising at least an upper coordinating rod and a lower coordinating rod) configured to affix banjo pot 401 securely to banjo neck 416. A plurality of additional fasteners 418 may be used for securely fastening neck 416 and pot 401 together.

The banjo 400 may additionally include a tailpiece 434 configured to affix banjo strings 420 at one end, and a bridge 414 positioned on an upper surface of head 428 and between tailpiece 434 and tuning pegs 430. The other end of strings 420 are affixed to tuning pegs 430, so that strings 420 are run between tailpiece 434 and tuning pegs 430 and pass over and in direct contact with bridge 414—thereby enabling strings 420 to be strung under tension between the two ends. By tightening the banjo strings 420 (by winding tuning pegs 430), this arrangement enables the banjo strings 420 to be strung under tension across banjo neck 416 and banjo head 410. Due to this arrangement, vibrations of strings 420 are transmitted through bridge 414 to banjo pot 401 head 410—which causes the banjo pot 401 and head 410 to resonate and generate sound waves.

The present invention provides an improved and optimized configuration for a stringed musical instrument that combines sound characteristics of a guitar and a banjo for a sound with unique and desirable tone, resonance and timbre characteristics. The invention achieves these objectives by mounting a banjo-type pot within a guitar-type hollow body—with a bridge positioned on the banjo head such that strings running between a tailpiece on the hollow body and tuning pegs on the neck of the musical instrument pass over and are in contact with the bridge, so as to transmit string vibrations through the bridge and through the banjo head into chamber formed by the banjo-type pot that is mounted within the guitar-type hollow body. The sound waves generated within the banjo-type pot due to the string vibrations causes further resonance within the guitar-type hollow body—resulting in improved sound characteristics. In an embodiment, the sound board of the guitar-type hollow body is provided with one or more openings to enable sound waves that have been generated within the banjo-type pot and which have passed through the interior chamber formed by the guitar-type hollow body to exit out of and away from the guitar-type hollow body. In a yet more preferable embodiment, the banjo-type pot is mounted on the back surface of the guitar-type hollow body such that the banjo-type pot only contacts the mount and/or the back of the guitar-type hollow body, and particularly does not contact the front or sound board of the guitar-type hollow body. As a result of this arrangement, the vibration or resonance of the sound board of the guitar-type hollow body (which is the most resonant part of the hollow body) is not impeded in any way by mounting of the banjo-type pot within the hollow body—which in turn results in an improved resonance, tone and timbre characteristics.

The above configuration for the stringed musical instrument of the present invention is illustrated and described in more detail in connection with FIGS. 5 to 16 below.

Figure 5:
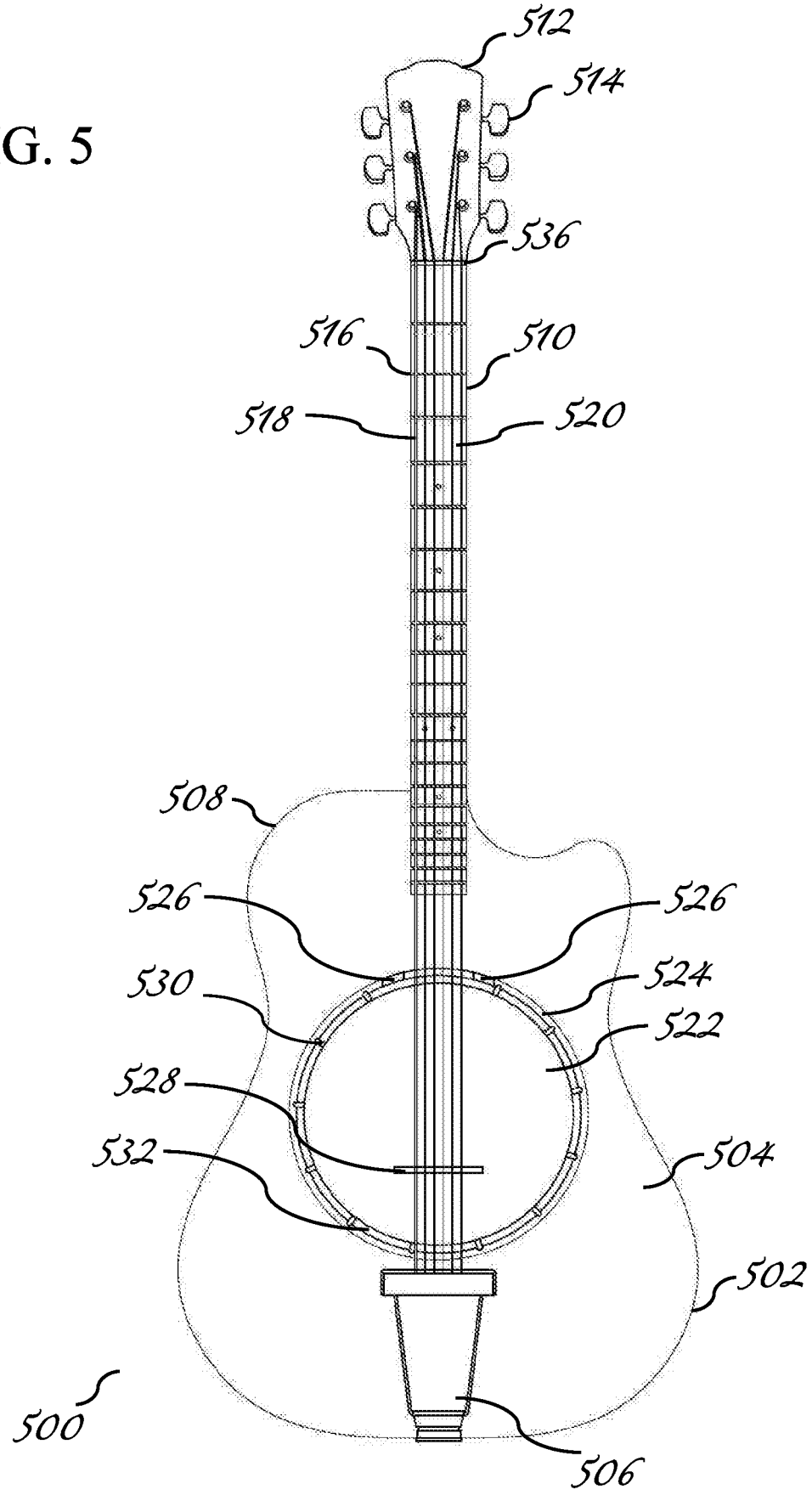
FIGS. 5 to 8 illustrate embodiments of a stringed musical instrument configured in accordance with the teachings of the present invention.
Figure 6:
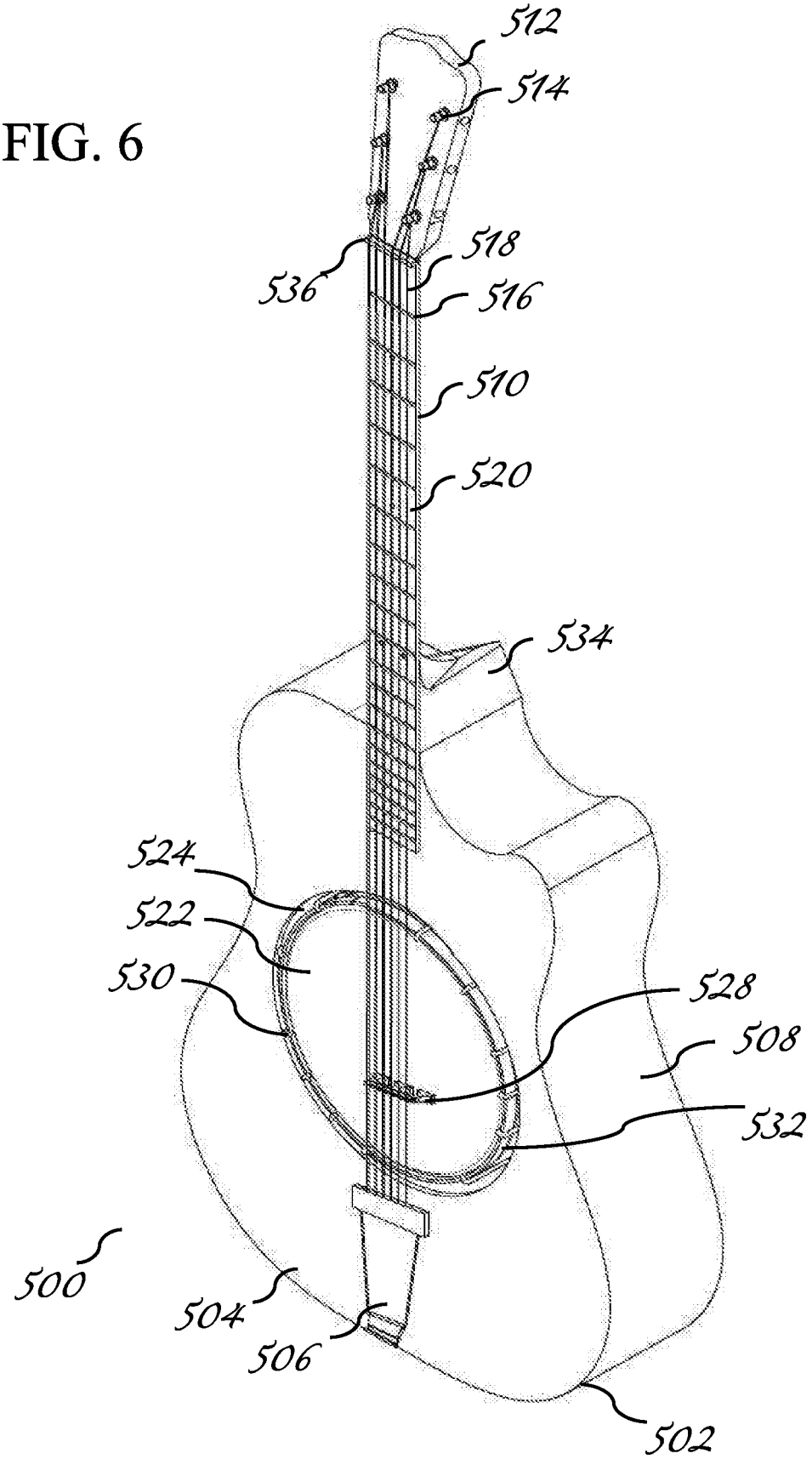

FIGS. 5 and 6 illustrate an embodiment 500 of the stringed musical instrument of the present invention.

The stringed musical instrument 500 comprises a guitar-type hollow body 502 and a neck 510 (for example, a guitar-type neck) that are affixed together. In an embodiment, the guitar-type hollow body 502 and/or neck 510 may have one or more of the structural configurations described in connection with FIGS. 1 and 2.

As shown in the figures, the guitar-type hollow body 502 comprises a front (sound board) 504 and a back (not visible) that are joined by sidewall(s) 508. Neck 510 may be joined to the guitar-type hollow body 502 at heel 534—wherein neck 510 may have a fretboard 520, a plurality of frets 516, a head 512 (for example, a guitar-type head), tuning pegs 514, and a nut 536 formed or disposed thereon.

Front 504 of guitar-type hollow body 502 is provided with an opening 524 (a or sound hole) which enables a banjo-type pot 521 to be inserted into the guitar-type hollow body 502. In the illustrated embodiment, opening 524 is a circular opening (but it would be understood that other regular or irregular shapes are also possible). In an embodiment, opening 524 may have a diameter that is larger than the diameter of banjo-type pot 521 at its widest point—which enables banjo-type pot 521 to be mounted within the guitar-type hollow body 502 without contacting the sides of opening 524 and/or front 504. In an embodiment, the diameter of opening 524 exceeds the diameter of banjo-type pot 521 (at its widest point) by between 6 mm and 18 mm. In another embodiment, the radius of opening 524 exceeds the radius of banjo-type pot 521 (at its widest point) by between 6 mm and 18 mm.

As described in FIG. 4, banjo-type pot 521 may comprise at least head 522, a rim (not shown), a tension hoop 532 and optionally one or more fasteners 530, a flange (not shown) and resonator (not shown). Banjo-type pot 521 may be mounted onto an inner surface of the back of the guitar-type hollow body 502 through one or more mounts (or supports) 526. The banjo-type pot 521 is mounted onto an inner surface of the back of the guitar-type hollow body 502 such that the head 522 of banjo-type pot 521 is positioned relatively proximal to front 504 of the guitar-type hollow body 502 and relatively distal to the back of said guitar-type hollow body 502. In an embodiment, the plane of the head 522 of banjo-type pot 521 is positioned substantially level with the plane of front 504 of guitar-type hollow body 502. In another embodiment, the plane of head 522 of banjo-type pot 521 is positioned within between 0 mm and 13 mm of the plane of the front 504 of the guitar-type hollow body 502. In one embodiment, the plane of head 522 of banjo-type pot 521 is positioned between 0 mm and 13 mm above the plane of the front 504 of the guitar-type hollow body 502. In another embodiment, the plane of head 522 of banjo-type pot 521 is positioned between 0 mm and 13 mm below the plane of the front 504 of the guitar-type hollow body 502.

As a result of the sizing of opening 524, when banjo-type pot 521 is mounted within guitar-type hollow body 502, an annular open space is formed between the external periphery of banjo-type pot 521 and the internal periphery of opening 524—which open space enables sound waves to emanate from hollow body 502. In an embodiment of the invention, opening 524 is sized such that fasteners 530 that surround banjo-type pot 521 for the purpose of securing together, head 522, tension hoop 532 and the rim (not shown) of the banjo-type pot 521, also do not contact the sides of opening 524 and/or front 504 of guitar-type hollow body 502.

When banjo-type pot 521 is mounted within guitar-type hollow body 502, bridge 528 is affixed or positioned on head 522 such that the strings 518 running between tailpiece 506 on the hollow body 502 and tuning pegs 514 on the neck 516 pass over and are in contact with the bridge 528, so as to transmit string vibrations through bridge 528 and head 522 into the chamber formed by the banjo-type pot 521 within the guitar-type hollow body 502. The sound waves generated within the banjo-type pot 521 due to the string vibrations cause further resonance within the guitar-type hollow body 502, particularly as a result of resonance characteristics of front 504. Opening 524 provided on front 504 permits sound waves that have been generated within banjo-type pot 521 and which have passed through the interior chamber formed by the guitar-type hollow body 502 to exit out of and away from the guitar-type hollow body 502.

In an embodiment, banjo-type pot 521 is mounted on an interior surface of the back of the guitar-type hollow body 502 in a manner such that the banjo-type pot 521 only contacts the mount(s) 526 and/or the back of the guitar-type hollow body 502, and does not contact the front 504 (i.e. the sound board) of the guitar-type hollow body 502. As a result of this arrangement, the vibration or resonance of the front/sound board 504 of the guitar-type hollow body 502 (which is the most resonant part of guitar-type hollow body 502) is not impeded or damped by the mounting of the banjo-type pot 521 within the guitar-type hollow body 502—which results in improved resonance, tone and timbre characteristics.

Figure 7:
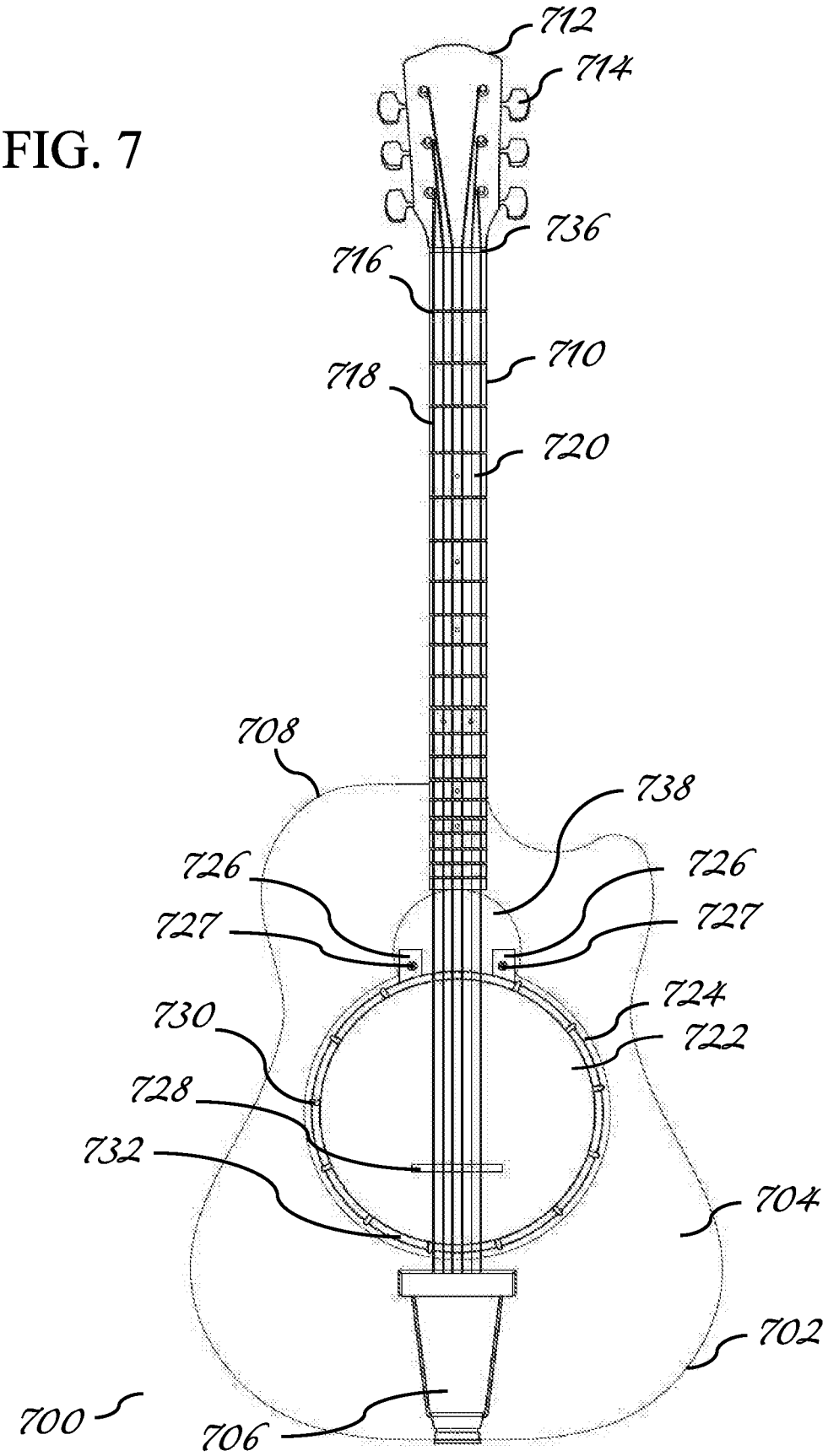
Figure 8:
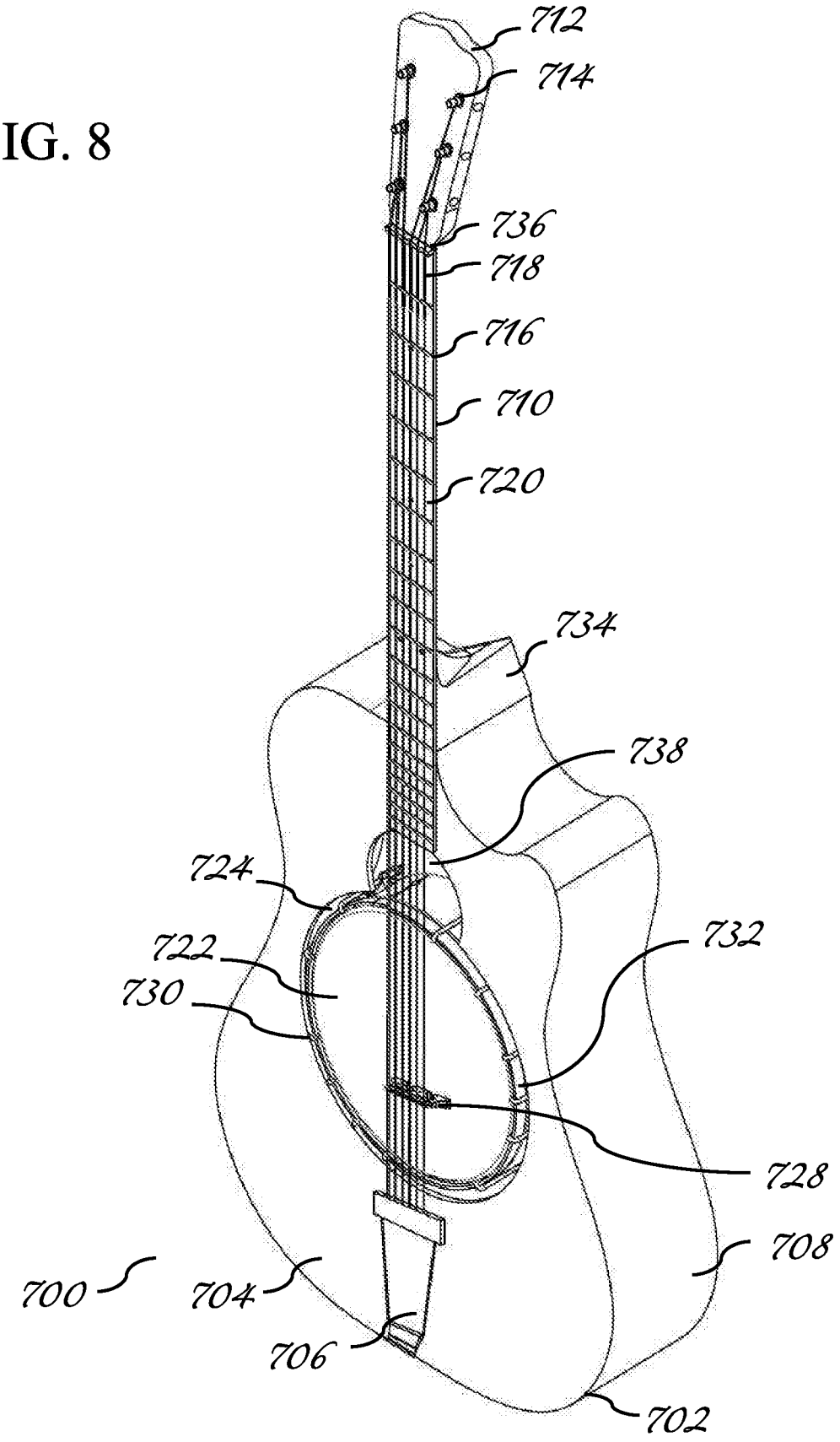

FIGS. 7 and 8 illustrate another embodiment 700 of the stringed musical instrument of the present invention.

The stringed musical instrument 700 comprises a guitar-type hollow body 702 and a neck 710 that are affixed together. As shown in the figures, the guitar-type hollow body 702 comprises a front (sound board) 704 and a back (not visible) that are joined by sidewall(s) 708. Neck 710 may be joined to the guitar-type hollow body 702 at heel 734—wherein neck 710 may have a fretboard 720, a plurality of frets 716, a head 712 (for example a guitar-type head), tuning pegs 714, and a nut 736 formed or disposed thereon.

Front 704 is provided with an opening 724 which enables a banjo-type pot 721 to be inserted into the guitar-type hollow body 702. In the illustrated embodiment, opening 724 is a circular opening (but it would be understood that other regular or irregular shapes are also possible). The opening 724 may have a diameter that is larger than the diameter of banjo-type pot 721 at its widest point—which enables banjo-type pot 721 to be inserted into and mounted within hollow body 702 without contacting the sides of opening 724 and/or front 704. In an embodiment, the diameter of opening 724 exceeds the diameter of banjo-type pot 721 (at its widest point) by between 6 mm and 18 mm. In another embodiment, the radius of opening 724 exceeds the radius of banjo-type pot 721 (at its widest point) by between 6 mm and 18 mm. In an embodiment, opening 724 partially or wholly overlaps with or subsumes a sound hole 738 (for example, any of a circular, ovoid or D-shaped sound hole) provided on front surface of guitar-type hollow body 702.

As described in FIG. 4, banjo-type pot 721 may comprise at least head 722, a rim (not shown), a tension hoop 732 and optionally one or more fasteners 730, a flange (not shown) and resonator (not shown). Banjo-type pot 721 may be mounted onto an inner surface of the back of the guitar-type hollow body 702 through one or more mounts (or supports) 726, preferably using one or more fasteners 727. The banjo-type pot 721 is mounted onto an inner surface of the back of the hollow body 702 such that head 722 of banjo-type pot 721 is positioned relatively proximal to front 704 of the guitar-type hollow body 702 and relatively distal to the back of said guitar-type hollow body 702. In an embodiment, the plane of head 702 of banjo-type pot 721 is positioned substantially level with the plane of front 704 of guitar-type hollow body 702. In another embodiment, the plane of head 722 of banjo-type pot 721 is positioned within between 0 mm and 13 mm of the plane of the front 704 of guitar-type hollow body 702. In one embodiment, the plane of head 722 of banjo-type pot 721 is positioned between 0 mm and 13 mm above the plane of the front 704 of the guitar-type hollow body 702. In another embodiment, the plane of head 722 of banjo-type pot 721 is positioned between 0 mm and 13 mm below the plane of the front 704 of the guitar-type hollow body 702.

As a result of the sizing of opening 724 (and potentially, the overlap between opening 724 and sound hole 738), when banjo-type pot 721 is mounted within guitar-type hollow body 702, an open space is formed between the external periphery of banjo-type pot 721 and the internal of opening 724 and/or sound hole 738—which open space enables sound waves to emanate from guitar-type hollow body 702. In an embodiment of the invention, opening 724 is sized such that fasteners 730 that surround banjo-type pot 721 for the purpose of affixing head 722, tension hoop 732 and the rim (not shown) of banjo-type pot 721 also do not contact the sides of opening 724 and/or front 704 of guitar-type hollow body 702.

When banjo-type pot 721 is mounted within hollow body 702, bridge 728 is positioned on head 722 of banjo-type pot 721 such that the strings 718 running between tailpiece 706 on guitar-type hollow body 702 and tuning pegs 714 on the neck 716 pass over and are in contact with the bridge 728, so as to transmit string vibrations through bridge 728 and head 722 (of banjo-type pot 721) into the chamber formed by the banjo-type pot 721 within guitar-type hollow body 702. The sound waves generated within the banjo-type pot 721 due to the string vibrations cause further resonance within the guitar-type hollow body 702, particularly as a result of resonance characteristics of front 704. Openings 724, 738 provided on front 704 permit sound waves that have been generated within banjo-type pot 721 and which have passed through the interior chamber formed by the guitar-type hollow body 702 to exit out of and away from the guitar-type hollow body 702.

In an embodiment, banjo-type pot 721 is mounted on an interior surface of the back of the guitar-type hollow body 702 in a manner such that the banjo-type pot 721 only contacts the mount(s) 726 and/or the back of the guitar-type hollow body 702, and does not contact the front 704 (i.e. the sound board) of the guitar-type hollow body 702. As a result of this arrangement, the vibration or resonance of the front/sound board 704 of the guitar body (which is the most resonant part of hollow body 702) is not impeded in any way by the mounting of the banjo-type pot 721 within the guitar-type hollow body 702—which results in improved resonance, tone and timbre characteristics.

Figure 9A:
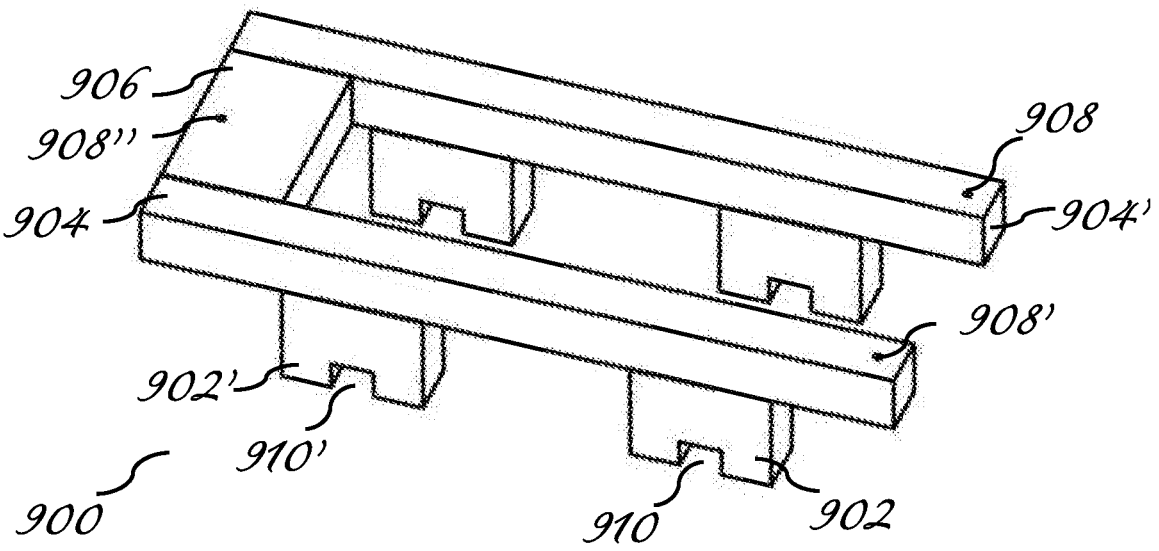
FIGS. 9A and 9B illustrate an exemplary mount that is used for mounting a banjo-type pot within a guitar-type hollow body, in accordance with the teachings of the present invention.
Figure 9B:
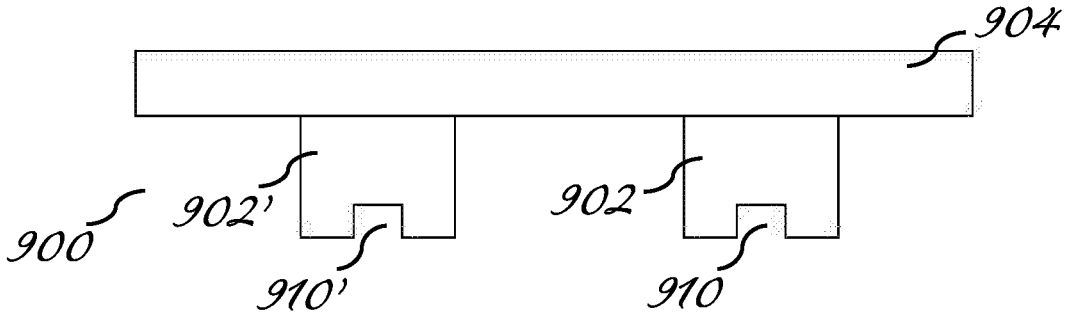

FIGS. 9A and 9B illustrate an exemplary mount 900 that is used for mounting a banjo-type pot (for example, banjo-type pot 521 or 721) within a guitar-type hollow body (for example hollow body 502, 702), in accordance with the teachings of the present invention.

As illustrated in the figures, mount 900 may comprise at least two support members 904, 904' each having one or more legs 902, 902'. Optionally, in the embodiment illustrated in FIGS. 9A and 9B the two support members 904, 904' are interconnected by a third support member 906 which joins the two support members 904, 904' to provide additional structural support and strength. Each of legs 902, 902' formed beneath support members 904 may comprise one or more recesses 910, 910' that are sized and configured to conform to an external periphery of a bracing strut on the back of a guitar-type hollow body—such that said leg 902,902' can be fitted over said bracing strut, to enable the mount 900 to be affixed to an interior surface of a back of a guitar-type hollow body, without interference from the bracing struts provided on said interior surface. One or more of support members 904, 904', 906 of mount 900 are provided with corresponding fastener holes 908, 908', 908" which are positioned and sized to receive fasteners (such as screws, bolts, rivets and/or other fastening members) that are used to affix a banjo-type pot to mount 900.

FIGS. 10A, 10B, 11A, 11B, 12A, 12B and 13 illustrate exemplary embodiments of mounts affixed within a guitar-type hollow body, in accordance with the teachings of the present invention.

Figure 10A:
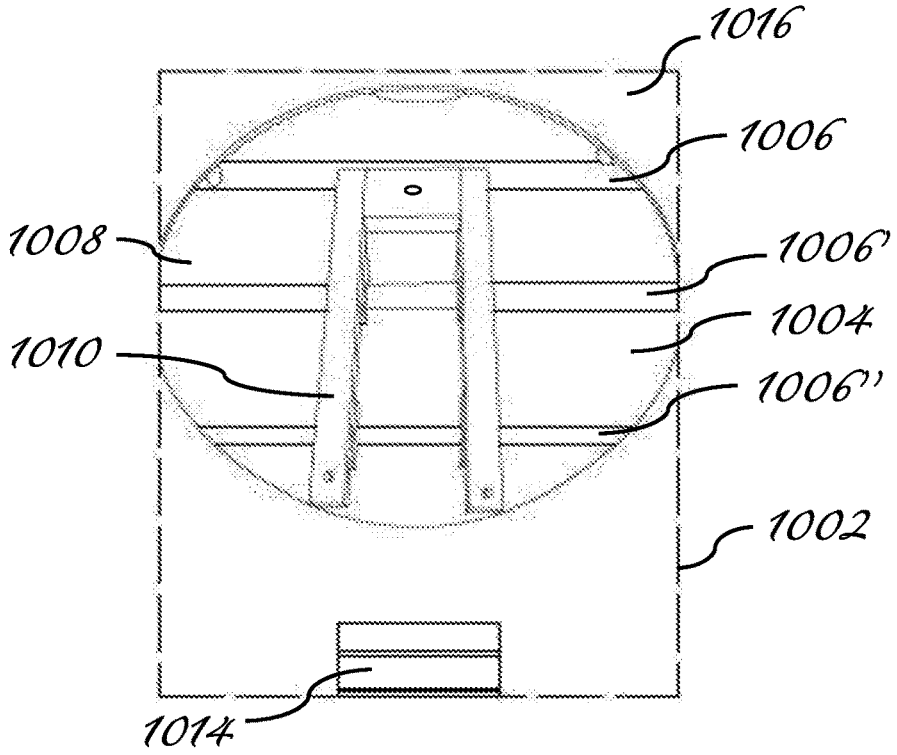

FIGS. 10A and 11A illustrate for the purposes of one embodiment of the invention, a portion of a guitar-type hollow body within which a mount of the type described in connection with FIGS. 9A and 9B has been affixed. As shown, a front 1016 (sound board) of guitar-type hollow body 1002 is provided with an opening 1004 (which in this illustration is a substantially circular opening), through which an interior chamber of guitar-type hollow body 1002 can be accessed. Also seen on front 1016 is a part of fretboard 1014 where a neck (for example, a guitar-type neck) is jointed to guitar-type hollow body 1002. Back 1008 of guitar-type hollow body 1002 is provided with a plurality of bracing struts 1006, 1006', 1006" for providing structural support to back 1008 and sidewall(s) of the guitar-type hollow body 1002.

A mount 1010 of the type described in connection with FIGS. 9A and 9B is mounted onto back 1008 of hollow body 1002—where it would be understood that the recesses 1020 provided on the legs 1018 of said mount 1010 enable the mount 1010 to be affixed securely to back 1008 without interference from bracing struts 1006, 1006', 1006".

It would be understood that mount 1010 can be affixed within guitar-type hollow body 1002 through (and further can be accessed or viewed through) the opening 1004 provided on the front 1016 of guitar-type hollow body 1002.

Figure 10B:
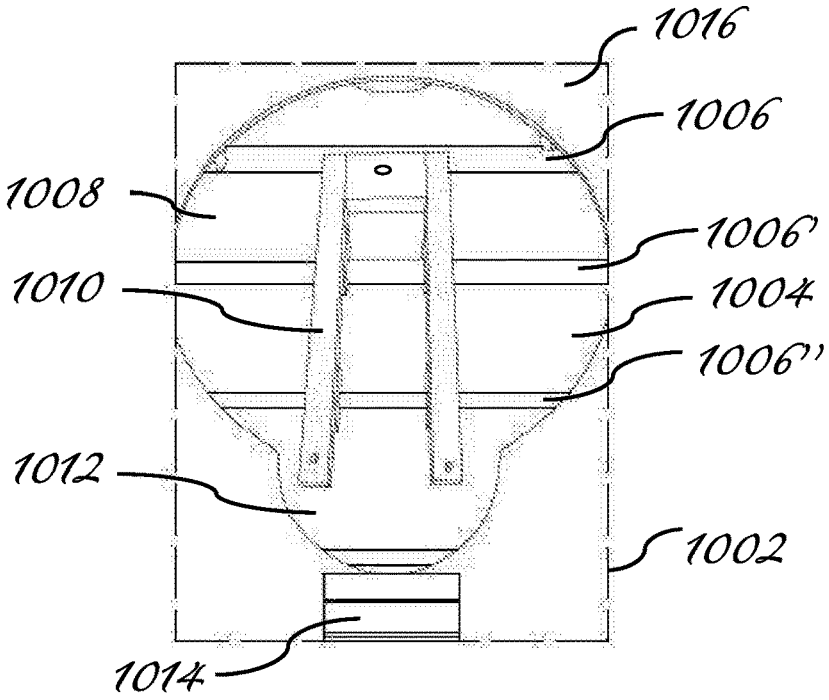

FIGS. 10B and 11B illustrate for the purposes of another embodiment of the invention, a portion of a guitar-type hollow body within which a mount of the type described in connection with FIGS. 9A and 9B has been affixed. This embodiment is similar to the embodiment of FIGS. 10A and 11A. However, the opening 1004 (which in this embodiment is a substantially circular opening), through which an interior chamber of guitar-type hollow body 1002 can be accessed, overlaps partially with a sound hole 1012 (for example, a guitar-type circular, D-shaped or ovoid sound hole) that is also provided on the front 1016 of guitar-type hollow body 1002. As in the case of FIGS. 10A and 11A, mount 1010 may be affixed within guitar-type hollow body 1002 through (and further can be accessed or viewed through) the combined openings 1004, 1012 provided on the front 1016 of guitar-type hollow body 1002.

Figure 12A:
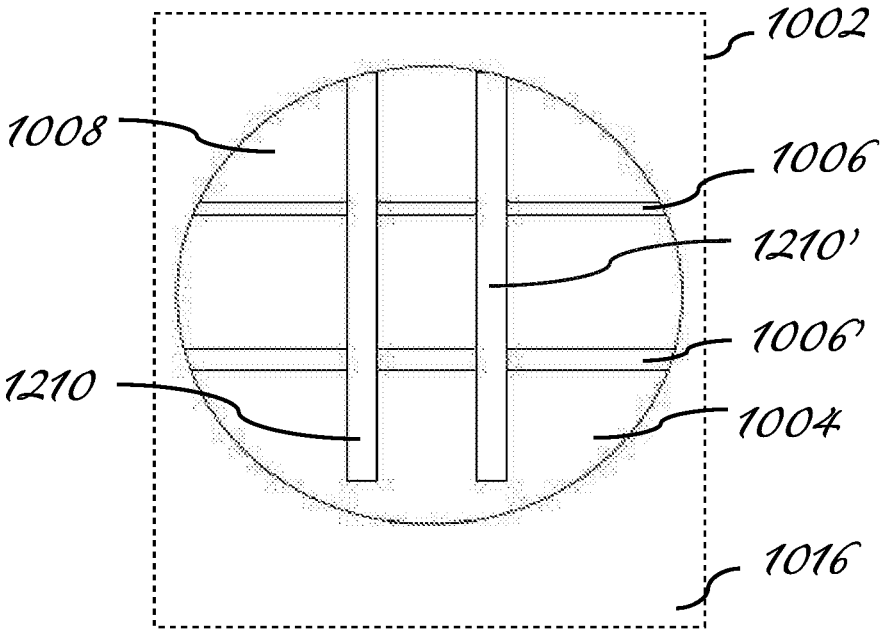

FIG. 12A illustrates for the purposes of another embodiment of the invention, a portion of a guitar-type hollow body within which a mount that is similar to the type described in connection with FIGS. 9A and 9B, has been affixed. While the mounting arrangement illustrated in this embodiment is similar to the mounting arrangement described in connection with FIGS. 10A to 11B, in this embodiment, the mount comprises two independent support members 1210 and 1210' and do not include a third support member interconnecting the two (which third support member is shown in the mount as illustrated in FIGS. 9A to 11B). As in the case of the earlier discussed embodiments of FIGS. 10A to 11B, a front 1016 of guitar-type hollow body 1002 is provided with an opening 1004 (which in this illustration is a substantially circular opening), through which an interior chamber of guitar-type hollow body 1002 can be accessed. Back 1008 of guitar-type hollow body 1002 is provided with a plurality of bracing struts 1006, 1006' for providing structural support to back 1008 and sidewall(s) of the guitar-type hollow body 1002. The independent support members 1210, 1210' are mounted onto back 1008 of guitar-type hollow body 1002—and (as in the case of FIGS. 10A to 11B) it would be understood that recesses provided on legs of said support members 1210, 1210' can enable the horizontal members 1210, 1210' to be affixed securely to back 1008 without interference from bracing struts 1006, 1006'.

It would also be understood that support members 1210, 1210' can be affixed within guitar-type hollow body 1002 through (and further can be accessed or viewed through) the opening 1004 provided on the front 1016 of guitar-type hollow body 1002.

Figure 12B:
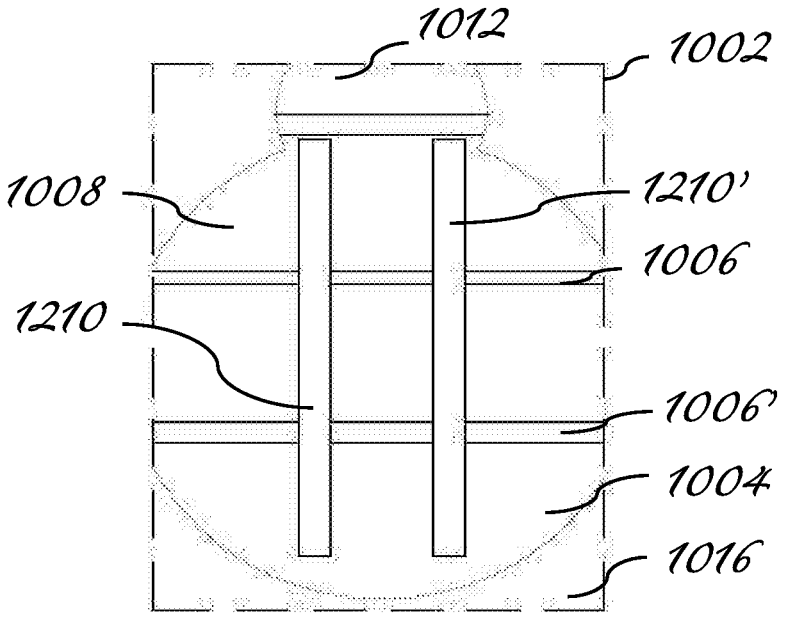

FIG. 12B illustrates for the purposes of another embodiment of the invention, a portion of a guitar-type hollow body within which support members of the type described in connection with FIG. 12A have been affixed. This embodiment is similar to the embodiment of FIG. 12A. However, the opening 1004 (which in this embodiment is a substantially circular opening), through which an interior chamber of guitar-type hollow body 1002 can be accessed, overlaps partially with a sound hole 1012 (for example, a guitar-type circular, D-shaped or ovoid sound hole) that is also provided on the front 1016 of hollow body 1002. As in the case of FIG. 12A, support members 1210, 1210' may be affixed within guitar-type hollow body 1002 through (and further can be accessed or viewed through) the combined openings 1004, 1012 provided on the front 1016 of guitar-type hollow body 1002.

Figure 13:
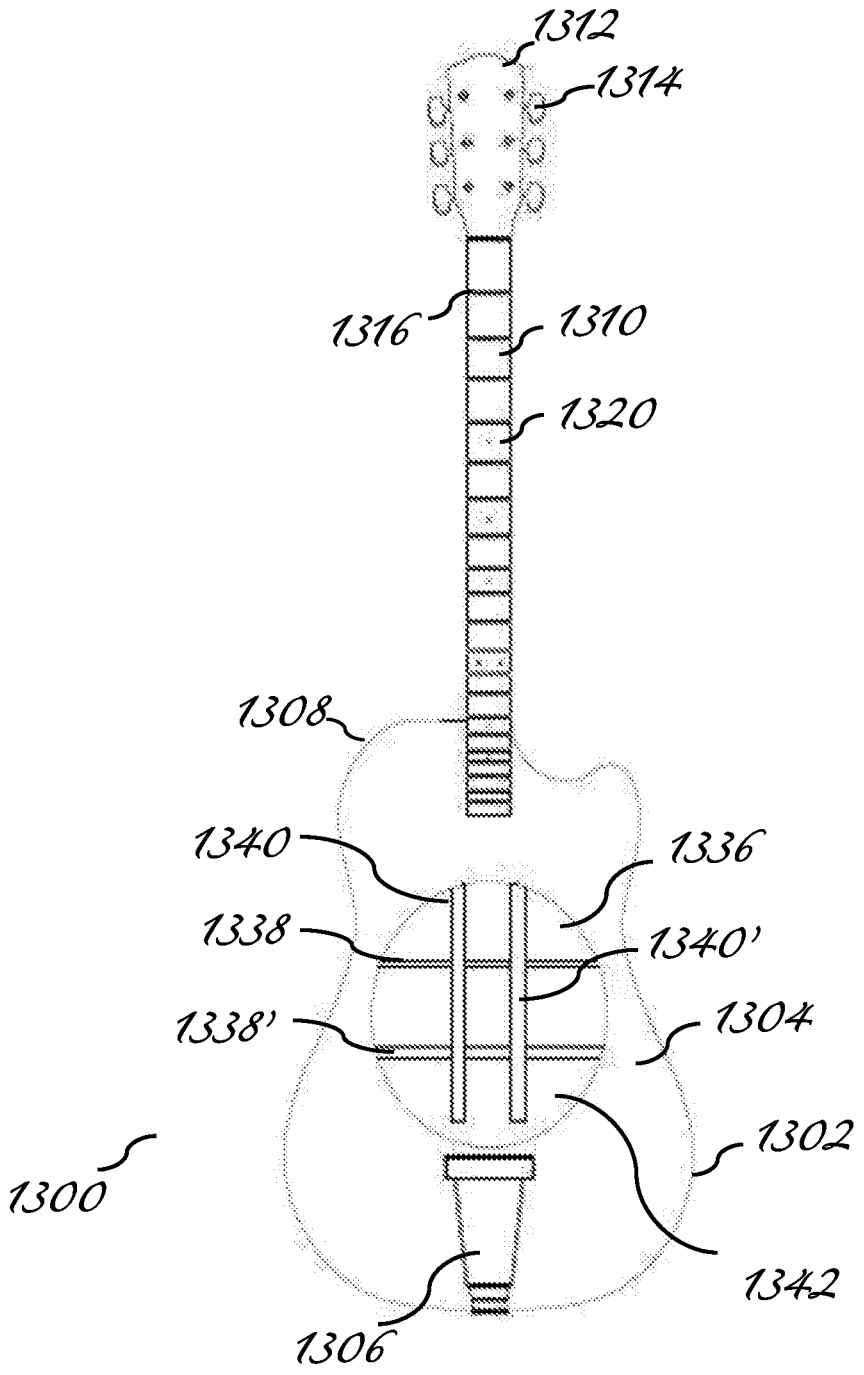

FIG. 13 illustrates a guitar-type hollow body 1302 for a musical instrument 1300 in accordance with the present invention, having affixed within an interior of the guitar-type hollow body 1302, a mount that is similar to the types described in connection with FIGS. 9A to 12B. As illustrated in FIG. 13, musical instrument 1300 has a guitar-type hollow body 1302 and a guitar-type neck 1310 affixed thereto. Neck 1310 includes guitar head 1312, tuning pegs 1314, frets 1316 and fretboard 1320. Neck 1310 may be affixed to hollow body 1302 by means of a heel (not shown).

Guitar-type hollow body 1302 comprises a front (sound board) 1304 and a back 1342 that are joined by sidewall(s) 1308. The guitar-type hollow body 1302 may include a plurality of bracing struts 1338, 1338' which internally support and reinforce the sidewall(s) 1308 and back 304 of the guitar-type hollow body.

Front 1304 is provided with an opening 1336 or sound hole through which an interior chamber of guitar-type hollow body 1302 can be accessed. Affixed to an interior surface of back 1342 of hollow body 1302, is a mount of the type illustrated in FIGS. 12A and 12B—comprising two independent support members 1340, 1340'. The independent support members 1340, 1340' are mounted onto an interior surface of back 1342 of guitar-type hollow body 1302. As in the case of the embodiments described above, recesses provided on legs of said support members 1340, 1340' enable said support members 1340, 1340' to be affixed securely to back 1342 without interference from bracing struts 1338, 1338'.

FIGS. 14A to 14D illustrate exemplary embodiments of a banjo-type pot 521 interfacing with a corresponding mount 900 for the purpose of affixing the banjo-type pot 521 within a guitar-type hollow body, in accordance with the teachings of the present invention.

Figure 14A:
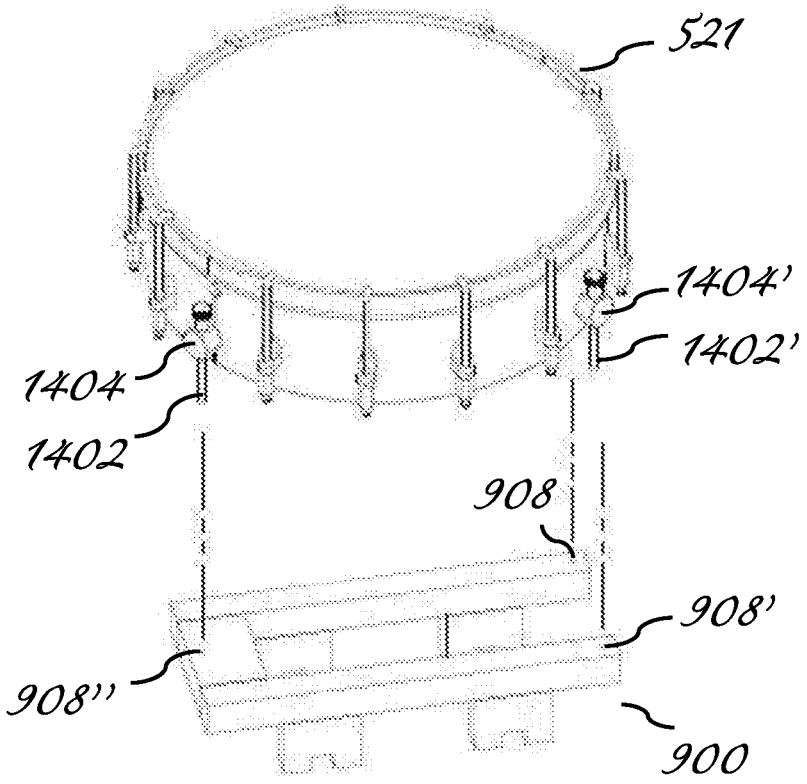
FIGS. 14A to 14D illustrate exemplary embodiments of a banjo-type pot interfacing with a corresponding mount for the purpose of affixing the banjo-type pot within a guitar-type hollow body, in accordance with the teachings of the present invention.
Figure 14B:
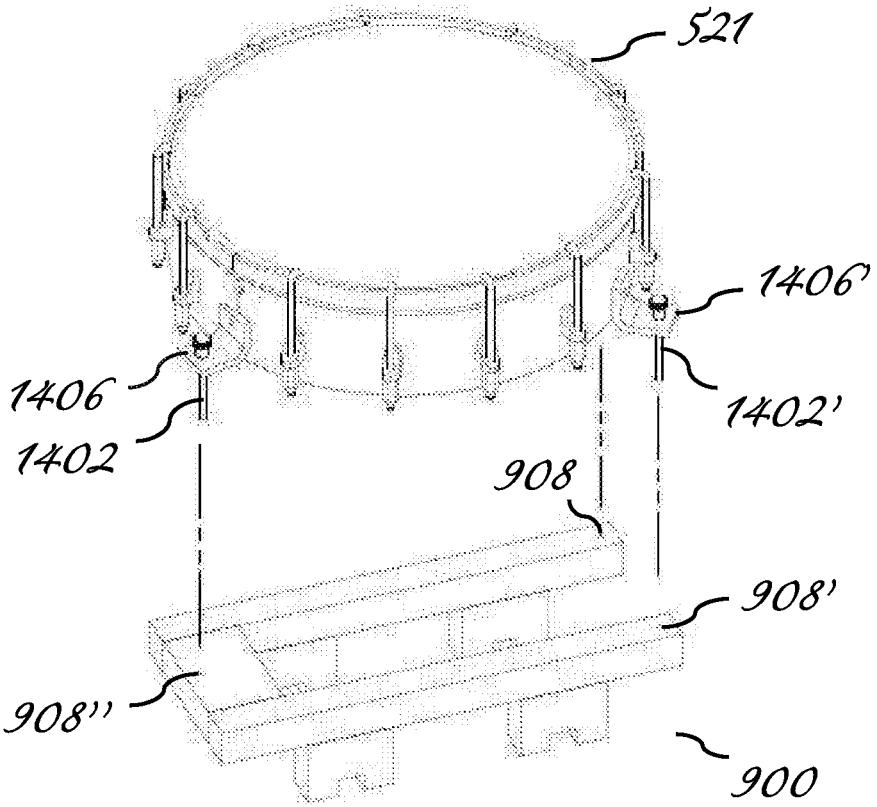

As shown in FIG. 14A, banjo-type pot 521 has affixed to (or has integrated therewith) a plurality of fastener brackets 1404, 1404', each fastener bracket having secured therewith, a corresponding fastener 1402, 1402' (for example, any of screws, rivets and/or pegs). Banjo-type pot 521 may be affixed to mount 900 using said fasteners 1402, 1402'. Said fasteners 1402, 1402' are received within corresponding fastener holes 908, 908', 908" provided on mount 900 and which are configured to receive and securely retain said fasteners 1404, 1404'—thereby ensuring that banjo-type pot 521 is securely affixed to mount 900. Mount 900 can in turn be affixed to an interior surface of a back of the stringed musical instrument within the guitar-type hollow body. In the illustrated embodiment, fastener brackets 1404, 1404' comprise a plurality of nut-type brackets configured to hold fasteners 1402, 1402'. In another embodiment illustrated in FIG. 14B, fasteners 1402, 1402' are held within fastener brackets 1406, 1406'—each of which fastener brackets comprises an L-bracket having one arm of the L-bracket affixed to the rim of banjo-type pot 521, and having another arm that is configured for being held in fixed engagement with mount 900 by means of fasteners 1402, 1402'.

Figure 14C:
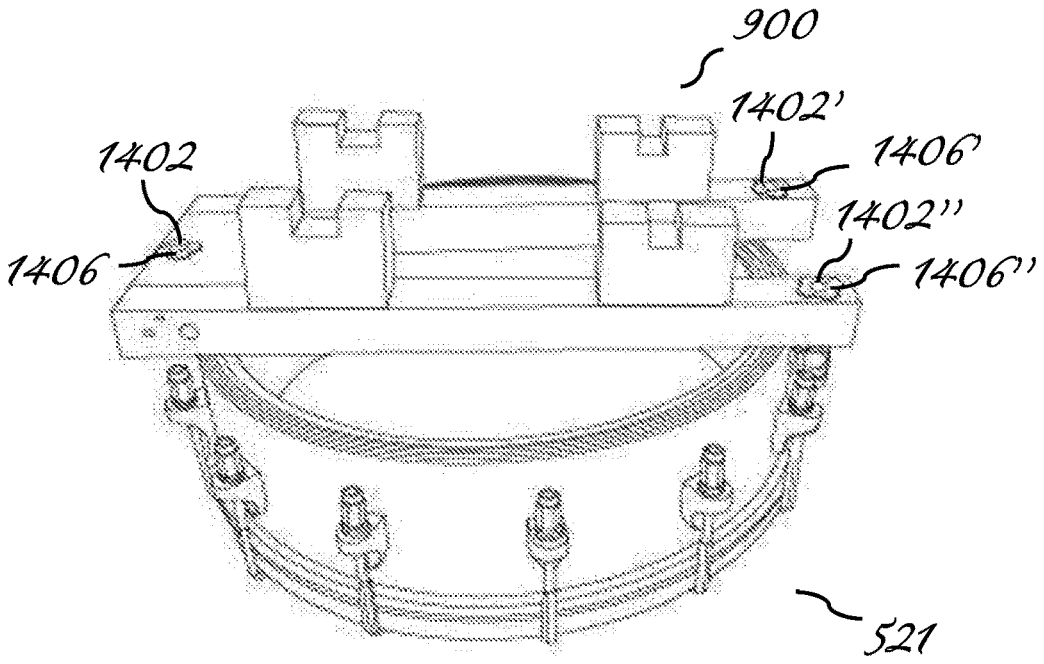
Figure 14D:
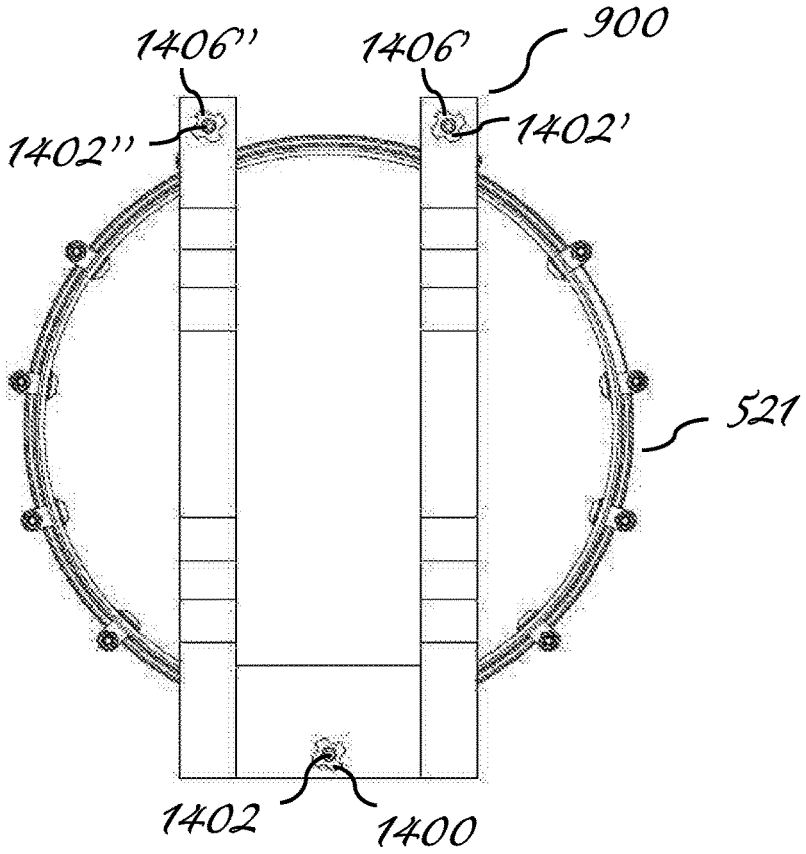

FIGS. 14C and 14D illustrate embodiments wherein banjo-type pot 521 has been affixed to mount 900 by means of fasteners 1402, 1402', 1402" and corresponding fastener nuts 1406, 1406', 1406". As shown fasteners 1402, 1402', 1402" that are affixed at a first end with banjo-type pot 521 are passed through corresponding holes in the support members of mount 900 and held in place by fastener nuts 1406, 1406', 1406"—thereby mounting or affixing banjo-type pot 521 onto mount 900.

It has been found that when affixing a banjo-type pot within an interior chamber of a guitar-type hollow body, the position (or displacement) of the head of the banjo-type pot relative to a plane of a front or sound board of the guitar-type hollow body is often critical to the resonant and tonal characteristics of the musical instrument. It has been found that adjusting the height of the mount within the guitar-type hollow body is a cumbersome and difficult process. In an embodiment therefore, the fasteners used to affix the banjo-type pot to the mount are height adjustable or depth adjustable fasteners that enable the height of the banjo-type pot to be adjusted relative to the mount (and therefore relative to a front or sound board) of the guitar-type hollow body.

Figure 15:
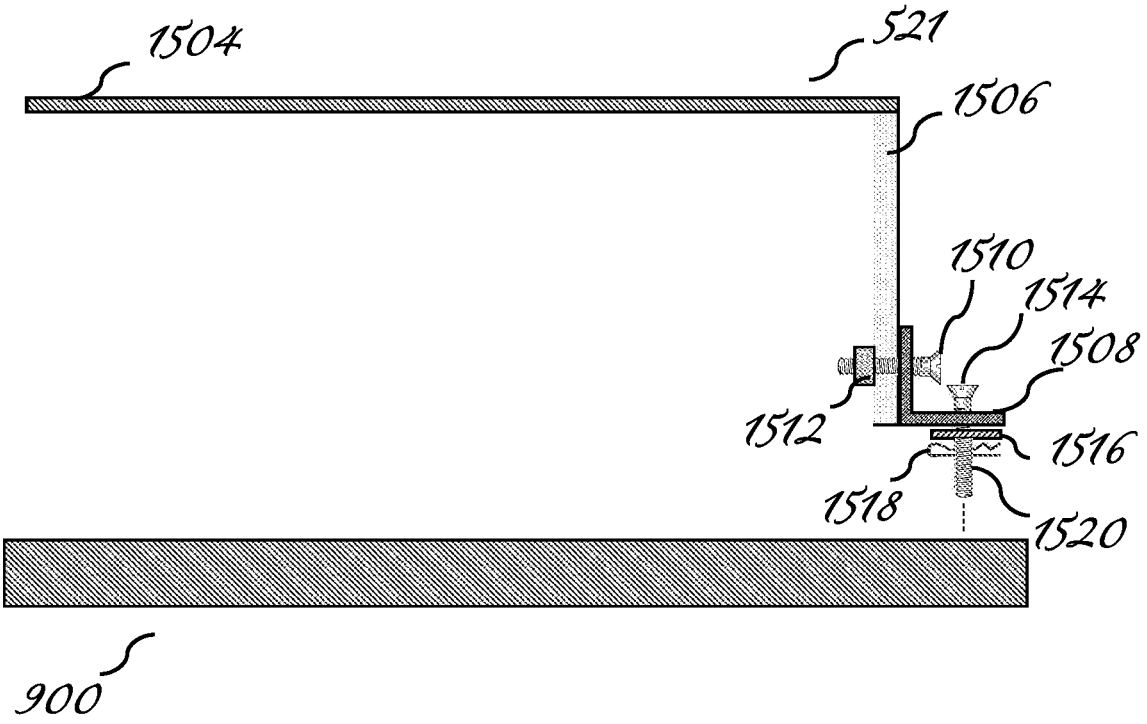
FIG. 15 illustrates an exemplary arrangement for adjusting the height of the banjo-type pot relative to the sound board of a guitar-type hollow body, in accordance with the teachings of the present invention.

FIG. 15 illustrates by way of a section-view, an exemplary arrangement for adjusting the height of the banjo-type pot relative to the front or sound board of a guitar-type hollow body, in accordance with the teachings of the present invention. In the illustration of FIG. 15, banjo-type pot 521 comprises a banjo-type pot head 1504 mounted on rim 1506. Rim 1506 has affixed thereto a first arm of an L-shaped fastening bracket 1508 by means of a first fastener or screw 1512 and a corresponding retaining nut 1512. The second arm of the L-shaped fastening bracket 1512 is fastened to mount 900 by means of a second fastener or screw 1514. As shown, the depth to which second fastener 1514 penetrates mount 900 can be controlled by providing, at a desired position or depth on the shank of second fastener 1514, a hole 1520 drilled through said shank and formed along a diameter of the shank. A horizontally positioned cotter pin 1518 may be driven through hole 1520—which is then held in a friction fit within hole 1520 and which restricts the shank of second fastener 1514 from being driven into mount 900 any further than the depth of hole 1520. In an embodiment, a washer 1516 may be additionally disposed around the shank of second fastener 1514 between the L-shaped fastening bracket 1508 and cotter pin 1518.

It will however be understood that any other height adjustable or depth adjustable fasteners may equally be implemented for affixing the banjo-type pot 521 to mount 900 and to control the height of the banjo-type pot relative to one or both of mount 900 or the sound board of the guitar-type hollow body.

Figure 16:
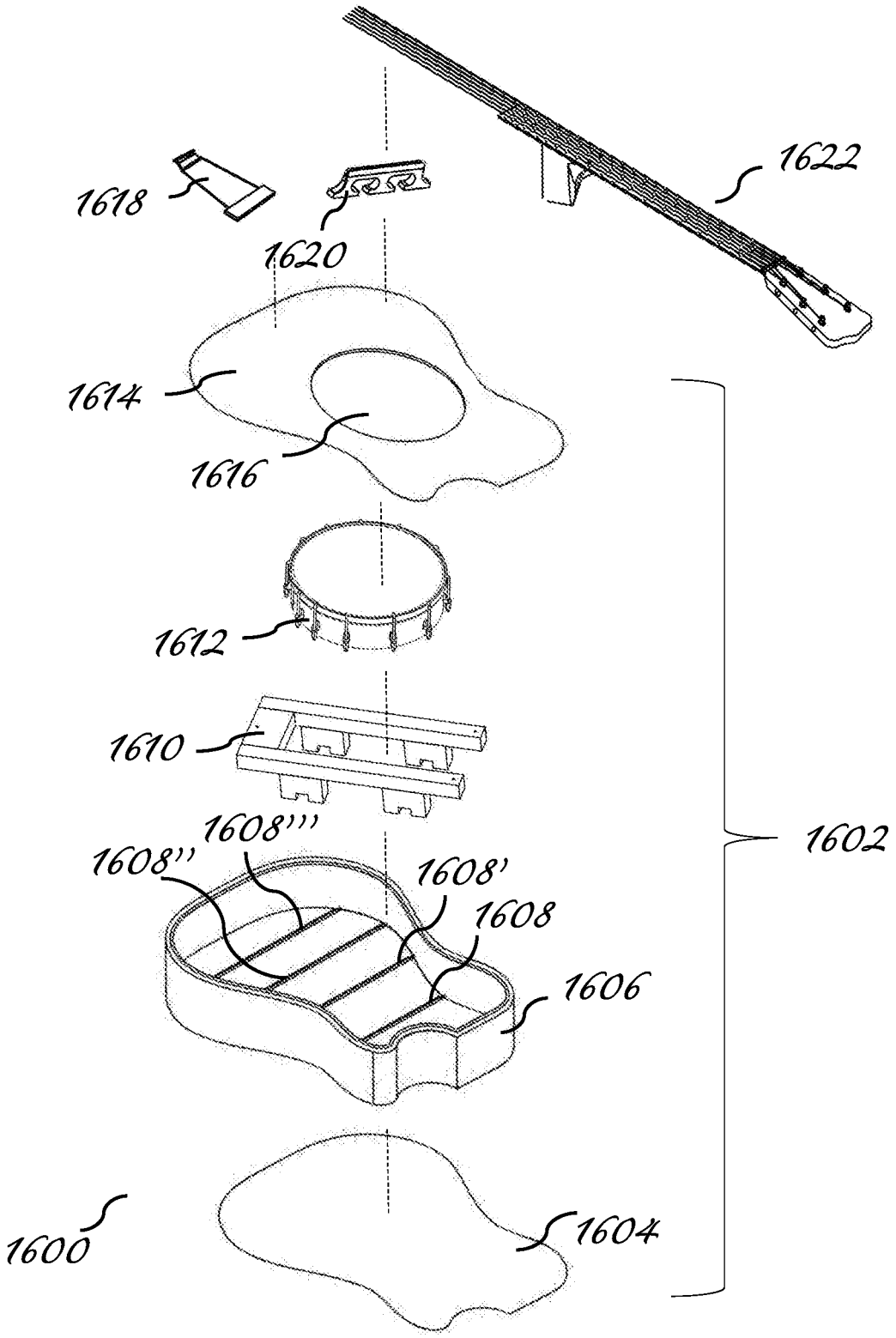
FIG. 16 is an exploded view of a stringed musical instrument that the sound characteristics of a guitar and a banjo, in accordance with the teachings of the present invention.

FIG. 16 is an exploded view of a stringed musical instrument that combines the sound characteristics of a guitar and a banjo, in accordance with the teachings of the present invention.

As shown in FIG. 16, a guitar-type hollow body 1602 of stringed musical instrument 1600 comprises a front (sound board) 1614 having an opening 1616 formed thereon, and a back 1604 that are joined by sidewall(s) 1606. The guitar-type hollow body 1602 may include a plurality of bracing struts 1608, 1608', 1608", and 1608' which internally support and reinforce the sidewall(s) 1606 and back 1604 of the guitar-type hollow body 1602.

Neck 1622 may be joined to the guitar-type hollow body 1602 by a heel formed on neck 1622—wherein neck 1622 may have any one or more a fretboard, a plurality of frets, a head, tuning pegs, and a nut formed or disposed thereon. An interior chamber of guitar-type hollow body 1602 may have a mount 1610 and a banjo-type pot 1612 positioned there within—wherein the mount 1610 is affixed to an interior surface of back 1604. As described in FIG. 4, banjo-type pot 1612 may comprise at least a banjo-type head, a rim, a tension hoop and optionally one or more fasteners, a flange and resonator. Banjo-type pot 1612 is in turn affixed to mount 1610. Opening 1616 is sized and positioned on front 1614 of guitar-type hollow body 1602 so as to enable banjo-type pot 1612 to be inserted into and mounted within guitar-type hollow body 1602, without contacting the sides of opening 1616 or front 1614. Front 1614 may have positioned thereon, a tailpiece 1618. Additionally bridge 1620 is positioned on a head of banjo-type pot 1612, such that a plurality of strings may be affixed at one end on tuning pegs of neck 1622 and may be run along the neck 1622 and over bridge 1620 so as to be affixed at a second end at tail piece 1618. By tightening the strings by winding the tuning pegs, this arrangement enables the strings to be strung under tension across neck 1622 and front 1614, such that vibrations of the strings are transmitted through the bridge 1620 and through the head of the banjo-type pot 1612 into a chamber formed by the banjo-type pot 1612 within the guitar-type hollow body 1602 of the musical instrument 1600. The sound waves generated within the banjo-type pot 1612 due to the string vibrations cause further resonance within the guitar-type hollow body 1602 of the musical instrument 1600—resulting in improved sound characteristics. Opening 1616 within front 1614 of the guitar-type hollow body 1602 of the musical instrument 1600 enable sound waves that have been generated within banjo-type pot 1612 and which have passed through the interior chamber formed by the guitar-type hollow body 1602 of the musical instrument 1600 to exit out of and away from the guitar-type hollow body 1602.

As discussed above, the banjo-type pot 1612 is mounted on the back surface of the guitar-type hollow body 1602 of the musical instrument 1600 in a manner such that the banjo-type pot 1612 only contacts the mount 1610 and/or the back 1604 of the guitar-type hollow body 1602, and does not contact the front surface or sound board 1614 of the guitar-type hollow body 1602. As a result of this arrangement, the vibration or resonance of the front 1614 of the musical instrument 1600 is not impeded in any way by the mounting of the banjo-type pot 1612 within the guitar-type hollow body 1602—which results in an improved resonance, tone and timbre characteristics.

In an embodiment, the invention provides a stringed musical instrument comprising a guitar-type hollow body, a neck, a banjo-type pot, a bridge and a set of strings.

The guitar-type hollow body comprises a front surface, a back surface and a sidewall joining the front surface and the back surface, wherein the front surface, back surface and sidewall define a first interior chamber within the hollow body, and wherein the front surface includes at least one opening provided thereon.

The neck is joined to the hollow body, wherein the neck is configured to enable strings to be strung under tension between a set of tuning pegs provided at one end of the neck and a set of one or more fasteners provided on an exterior surface of the hollow body.

The banjo-type pot comprises at least a rim, a head and a tension hoop, positioned within the first interior chamber within the hollow body, wherein the rim and head define a second interior chamber within the banjo-type pot, and wherein the banjo-type pot is affixed to the back surface of the hollow body such that the head of the banjo-type pot is positioned relatively proximal to the front surface of the hollow body and relatively distal to the back surface of the hollow body.

The bridge may be positioned on the head of the banjo type pot between the set of tuning pegs and the set of one or more fasteners provided on the exterior surface of the hollow body.

Each string within the set of strings is affixed at a first end to a tuning peg within the set of tuning pegs and at a second end to a fastener within the set of one or more fasteners provided on the exterior surface of the hollow body and strung under tension applied between the first end and the second end such that each string is passed over the bridge positioned on the head of the banjo type pot.

The banjo-type pot may be configured and positioned within the first interior chamber within the hollow body to form a path for sound waves generated by the head to travel from the second interior chamber within the banjo-type pot through the first interior chamber within the hollow body and out of the at least one opening provided on the front surface of the hollow body.

In an embodiment of the stringed musical instrument, the banjo-type pot is substantially cylindrical, and the at least one opening provided on the front surface of the hollow body may have a diameter that is greater than a diameter of the banjo-type pot at its widest point.

In a further embodiment of the stringed musical instrument, the banjo-type pot may be affixed within the first interior chamber such that an annular space is formed between a periphery of the banjo-type pot and an internal periphery of the at least one opening.

In a particular embodiment, the banjo-type pot may be affixed within the first interior chamber such that direct contact between the front surface of the hollow body and the banjo-type pot is entirely eliminated.

The stringed musical instrument may be configured such that a plane of the head of the banjo-type pot is positioned substantially level with a plane of the front surface of the hollow body.

In another embodiment, a plane of the head of the banjo-type pot is positioned within a distance of between 0 mm and 13 mm of a plane of the front surface of the hollow body. In one embodiment, the plane of the head of the banjo-type pot is positioned between 0 mm and 13 mm above the plane of the front of the guitar-type hollow body. In another embodiment, the plane of the head of the banjo-type pot is positioned between 0 mm and 13 mm below the plane of the front 504 of the guitar-type hollow body 502.

The banjo-type pot may be affixed to the back surface of the hollow body through a mount that is affixed to the back surface of the hollow body, and to which mount, one or more surfaces of the banjo-type pot is affixed.

The mount comprises at least two support members, each sized and positioned to be enable the rim of the banjo-type pot to be affixed thereto.

In an embodiment, the mount comprises a third support member interconnecting the at least two support members.

The mount may include one or more legs having one or more recesses provided thereon, wherein each recess is sized to accommodate a bracing strut located within the hollow body.

The stringed musical instrument may further comprise one or more rim fasteners, each configured to affix the rim of the banjo-type pot to the mount. The one or more of the rim fasteners may comprise height selective rim fasteners—which in an embodiment may be configured to enable the banjo-type pot to be affixed to the mount so as to ensure a pre-defined distance separating a lower surface of the rim of the banjo-type pot and an upper surface of said mount.

While the exemplary embodiments of the present invention are described and illustrated herein, it will be appreciated that they are merely illustrative. It will be understood by those skilled in the art that various modifications in form and detail may be made therein without departing from or offending the spirit and scope of the invention as defined by the appended claims. Additionally, the invention illustratively disclose herein suitably may be practiced in the absence of any element which is not specifically disclosed herein—and in a particular embodiment specifically contemplated, is intended to be practiced in the absence of any element which is not specifically disclosed herein.

What is claimed is:

1. A stringed musical instrument comprising:

a guitar-type hollow body comprising a front surface, a back surface and a sidewall joining the front surface and the back surface, wherein the front surface, back surface and sidewall define a first interior chamber within the hollow body, and wherein the front surface includes at least one opening provided thereon;

a neck joined to the hollow body, wherein the neck is configured to enable strings to be strung under tension between a set of tuning pegs provided at one end of the neck and a set of one or more fasteners provided on an exterior surface of the hollow body; and a banjo-type pot comprising at least a rim, a head and a tension hoop, positioned within the first interior chamber within the hollow body, wherein the rim and head define a second interior chamber within the banjo-type pot, and wherein the banjo-type pot is affixed to the back surface of the hollow body such that the head of the banjo-type pot is positioned relatively proximal to the front surface of the hollow body and relatively distal to the back surface of the hollow body;

a bridge positioned on the head of the banjo type pot between the set of tuning pegs and the set of one or more fasteners provided on the exterior surface of the hollow body; and a set of strings, each affixed at a first end to a tuning peg within the set of tuning pegs and at a second end to a fastener within the set of one or more fasteners provided on the exterior surface of the hollow body and strung under tension applied between the first end and the second end such that each string is passed over the bridge positioned on the head of the banjo type pot;

wherein the banjo-type pot is configured and positioned within the first interior chamber within the hollow body to form a path for sound waves generated by the head to travel from the second interior chamber within the banjo-type pot through the first interior chamber within the hollow body and out of the at least one opening provided on the front surface of the hollow body.

2. The stringed musical instrument as claimed in claim 1, wherein the banjo-type pot is substantially cylindrical, and wherein the at least one opening provided on the front surface of the hollow body has a diameter that is greater than a diameter of the banjo-type pot at its widest point.

3. The stringed musical instrument as claimed in claim 2, wherein the banjo-type pot is affixed within the first interior chamber such that an annular space is formed between a periphery of the banjo-type pot and an internal periphery of the at least one opening.

4. The stringed musical instrument as claimed in claim 2, wherein the banjo-type pot is affixed within the first interior chamber such that direct contact between the front surface of the hollow body and the banjo-type pot is entirely eliminated.

5. The stringed musical instrument as claimed in claim 1, wherein a plane of the head of the banjo-type pot is positioned substantially level with a plant of the front surface of the hollow body.

6. The stringed musical instrument as claimed in claim 1, wherein a plane of the head of the banjo-type pot is positioned within a distance of between 0 mm and 13 mm of a plane of the front surface of the hollow body.

7. The stringed musical instrument as claimed in claim 1, wherein the banjo-type pot is affixed to the back surface of the hollow body through a mount that is affixed to the back surface of the hollow body, and to which mount, one or more surfaces of the banjo-type pot is affixed.

8. The stringed musical instrument as claimed in claim 7, wherein the mount comprises at least two support members, each sized and positioned to be enable the rim of the banjo-type pot to be affixed thereto.

9. The stringed musical instrument as claimed in claim 8, wherein the mount comprises a third support member interconnecting the at least two support members.

10. The stringed musical instrument as claimed in claim 8, wherein the one or more height selective rim fasteners are configured to enable the banjo-type pot to be affixed to the mount so as to ensure a pre-defined distance separating a lower surface of the rim of the banjo-type pot and an upper surface of said mount.

11. The stringed musical instrument as claimed in claim 7, wherein the mount includes one or more legs having one or more recesses provided thereon, wherein each recess is sized to accommodate a bracing strut located within the hollow body.

12. The stringed musical instrument as claimed in claim 7, further comprising one or more rim fasteners, each configured to affix the rim of the banjo-type pot to the mount.

13. The stringed musical instrument as claimed in claim 7, wherein one or more of the rim fasteners are height selective rim fasteners.

* * * * *